US007621860B2

(12) United States Patent
Burrell

(10) Patent No.: US 7,621,860 B2
(45) Date of Patent: Nov. 24, 2009

(54) EXERCISE SITTING APPARATUS FOR ENHANCING MUSCLE DEVELOPMENT, STRENGTH, FLEXIBILITY AND/OR REHABILITATION

(76) Inventor: Michael Travis Burrell, 11693 San Vicente Blvd. #220, Los Angeles, CA (US) 90049

( * ) Notice: Subject to any disclaimer, the term of this patent is extended or adjusted under 35 U.S.C. 154(b) by 153 days.

(21) Appl. No.: 11/915,769

(22) PCT Filed: Dec. 14, 2006

(86) PCT No.: PCT/US2006/021198

§ 371 (c)(1),
(2), (4) Date: Nov. 28, 2007

(87) PCT Pub. No.: WO2006/132891

PCT Pub. Date: Dec. 14, 2006

(65) Prior Publication Data

US 2008/0182736 A1 Jul. 31, 2008

Related U.S. Application Data

(60) Provisional application No. 60/686,894, filed on Jun. 3, 2005.

(51) Int. Cl.
*A63B 22/06* (2006.01)

(52) U.S. Cl. ..... 482/142; 482/92; 297/411.35

(58) Field of Classification Search ..... 482/92, 482/93, 114, 118, 126, 127, 133, 134, 135, 482/136, 137, 140, 142, 146, 147; 297/183.9, 297/411.35, 411.36, 411.37
See application file for complete search history.

(56) References Cited

U.S. PATENT DOCUMENTS

| | | | | |
|---|---|---|---|---|
| 3,622,202 | A | 11/1971 | Brown | |
| 3,659,844 | A * | 5/1972 | Cummins | 482/130 |
| 3,992,057 | A | 11/1976 | Studebaker | |
| 4,834,452 | A | 5/1989 | Goodrich | |
| 5,052,684 | A * | 10/1991 | Kosuge et al. | 482/118 |
| 5,088,473 | A | 2/1992 | Chen et al. | |
| 5,165,389 | A | 11/1992 | Chen et al. | |
| 5,360,383 | A | 11/1994 | Boren | |
| 5,415,609 | A | 5/1995 | Yang | |
| 5,454,773 | A | 10/1995 | Blanchard | |
| 6,106,440 | A | 8/2000 | Olbrish, Jr. | |
| 6,248,047 | B1 | 6/2001 | Abdo | |
| 6,485,398 | B1 * | 11/2002 | Kreft | 482/94 |
| 6,918,861 | B2 | 7/2005 | Liao et al. | |
| 7,134,989 | B2 * | 11/2006 | Liao | 482/142 |

(Continued)

*Primary Examiner*—Loan H Thanh
*Assistant Examiner*—Tam Nguyen
(74) *Attorney, Agent, or Firm*—Tsircou Law, P.C.

(57) ABSTRACT

The present invention provides a cost-effective, mobile, adjustable, versatile, reliable and easy-to-use exercise sitting apparatus that permits a user to develop, strengthen, stretch, increase the flexibility of and/or rehabilitate, and to eliminate or reduce pain (if present) associated with, a wide variety of muscles and/or body parts, such as the abdominal, lower back, external oblique and/or hip flexor muscles. The user of the exercise sitting apparatus may be of normal health, disabled, suffering from a disease or recovering from an illness, injury, accident or surgery. The exercise sitting apparatus comprises a platform, a turntable assembly, a slide plate assembly, a supporting structure and a base. It can be used virtually anywhere, for example, in a home, an office, a gym, a hospital, a rehabilitative facility, a back pain center, a nursing home or the like.

21 Claims, 13 Drawing Sheets

U.S. PATENT DOCUMENTS 7,235,040 B2 * 6/2007 Chung-Ting ..... 482/93
2004/0067824 A1 4/2004 Chung-Ting
2005/0101460 A1 * 5/2005 Lobban ..... 482/140
2005/0130816 A1 * 6/2005 Huang ..... 482/140

* cited by examiner

EXERCISE SITTING APPARATUS FOR ENHANCING MUSCLE DEVELOPMENT, STRENGTH, FLEXIBILITY AND/OR REHABILITATION

FIELD OF THE INVENTION

This application is a non-provisional utility patent application that is filed from, and claims the benefit of, prior pending provisional patent application U.S. Ser. No. 60/686,894, filed on Jun. 3, 2005, which is hereby incorporated into this non-provisional patent application in its entirety by reference.

BACKGROUND OF THE INVENTION

The present invention is directed to an exercise sitting apparatus named "Swivel Hips" that permits a user, who may have normal health, be disabled, have impaired health or be recovering from an illness, sports (or other) injury, accident, surgery or other medical treatment or intervention, and who may have a normal or limited (less than normal) range of motion, to develop, strengthen, stretch, increase the flexibility of and/or rehabilitate one or more of a wide variety of muscles, such as the abdominal, lower back, external oblique and/or hip flexor muscles, or body parts, such as the neck, shoulders, back, hips, abdomen, legs and/or arms.

1. Background

There are more than 600 muscles in the body, which together account for about 40 percent of an individual's weight. Most skeletal muscles have names that describe some feature of the muscle. Often several criteria are combined into one name. Terms that relate to muscle features, and that are used in naming muscles, include size [vastus (huge), maximus (large), longus (long), minimus (small) and brevis (short)], shape [deltoid (triangular), rhomboid (like a rhombus with equal and parallel sides), latissimus (wide), teres (round) and trapezius (like a trapezoid, a four-sided figure with two sides parallel)], direction of fibers [rectus (straight), transverse (across), oblique (diagonally) and orbicularis (circular)], location [pectoralis (chest), gluteus (buttock or rump), brachii (aim), supra- (above), infra- (below), sub- (under or beneath) and lateralis (lateral)], number of origins [biceps (two heads), triceps (three heads) and quadriceps (four heads)], origin and insertion [sternocleidomastoideus (origin on the sternum and clavicle, insertion on the mastoid process) and brachioradialis (origin on the brachium or arm, insertion on the radius)], action [abductor (to abduct a structure), adductor (to adduct a structure), flexor (to flex a structure), extensor (to extend a structure), levator (to lift or elevate a structure) and masseter (a chewer)].

Some of the significant muscles of the human body are arranged in groups according to location and/or function. The muscles of the abdominal wall or trunk, for example, include those that move the vertebral column, the muscles that form the thoracic and abdominal walls, and those that cover the pelvic outlet. These muscles include the pectoralis major, external oblique, internal oblique, rectus abdominis and transverse abdominis.

The erector spinae group of muscles on each side of the vertebral column is a large muscle mass that extends from the sacrum to the skull. These muscles are primarily responsible for extending the vertebral column to maintain erect posture. The deep back muscles occupy the space between the spinous and transverse processes of adjacent vertebrae.

The muscles of the thoracic wall are involved primarily in the process of breathing. The intercostal muscles are located in spaces between the ribs. They contract during forced expiration. External intercostal muscles contract to elevate the ribs during the inspiration phase of breathing. The diaphragm is a dome-shaped muscle that forms a partition between the thorax and the abdomen. It has three openings in it for structures that have to pass from the thorax to the abdomen.

The abdomen, unlike the thorax and pelvis, has no bony reinforcements or protection. The wall consists entirely of four muscle pairs, arranged in layers, and the fascia that envelops them.

Neck muscles include the sternocleidomastoid and the trapezius muscles. The muscles of the upper extremity include those that attach the scapula to the thorax and generally move the scapula, those that attach the humerus to the scapula and generally move the arm, and those that are located in the arm or forearm that move the forearm, wrist, and hand. Some of these muscles include the deltoid, biceps brachii, brachioradialis and triceps brachii. Muscles that move the shoulder and arm include the trapezius and serratus anterior muscles. The pectoralis major, latissimus dorsi, deltoid, and rotator cuff muscles connect to the humerus and move the arm. The muscles that move the forearm are located along the humerus, which include the triceps brachii, biceps brachii, brachialis, and brachioradialis.

The muscles that move the thigh have their origins on some part of the pelvic girdle and their insertions on the femur. The largest muscle mass belongs to the posterior group, the gluteal muscles which, as a group, abduct the thigh. The iliopoas, an anterior muscle, flexes the thigh. The muscles in the medial compartment adduct the thigh. Some of the muscles of the lower extremity include the sartorius, rectus femoris, vastus lateralis, vastus medialis, gastrocnemius, tibialis anterior and soleus.

Muscles that move the leg are located in the thigh region. The quadriceps femoris muscle group straightens the leg at the knee. The hamstrings are antagonists to the quadriceps femoris muscle group, which are used to flex the leg at the knee.

The muscles located in the leg that move the ankle and foot are divided into anterior, posterior and lateral compartments. The tibialis anterior, which dorsiflexes the foot, is antagonistic to the gastrocnemius and soleus muscles, which plantar flex the foot.

Individuals who suffer from neck, shoulder, arm, upper back, mid back, lower back, hip, leg, foot, muscle and/or other types of pain are often encouraged by physicians and physical therapists to participate in their own recovery through exercise and physical therapy. These individuals can generally reduce or eliminate their pain, and/or improve their ability for avoiding recurrences of pain, by rehabilitating their painful body part or muscles through appropriate exercise, whether they are experiencing their first bout with pain or have had extensive treatments or surgeries. These individuals, however, are seldom given the tools that are needed to accomplish this rehabilitation on their own, or in their own environment (home, office, other place of employment, etc.).

It would be very beneficial to provide a cost-effective, mobile, adjustable, versatile, reliable and easy-to-use exercise sitting apparatus that permits a user to develop, strengthen, stretch, increase the flexibility of and/or rehabilitate, and to eliminate or reduce pain (if present) associated with, a wide variety of muscles and/or body parts, and that may be easily manufactured and/or marketed.

2. Description of Related Art

U.S. Pat. No. 3,992,057 describes a chair that is stated to be accommodating for children with cerebral palsy and to allow such children to develop more normally. The chair is stated to comprise a board-type back, a board-type seat, a pair of parallel disposed board-type brackets, a strap having means for fastening the ends thereof and a pair of adjustable, removable arm rests.

U.S. Pat. No. 6,106,440 describes a wheelchair exercise system for allowing wheelchair users to strengthen, rehabilitate and develop their muscles. The wheelchair exercise system is stated to comprise a wheelchair having a frame, a seat coupled to the frame, a backrest, a pair of ground rear wheels, a pair of downwardly depending front legs, a front yoke, a front axle and a pair of foot pedals.

SUMMARY OF THE INVENTION

The exercise sitting apparatus of the present invention advantageously provides a cost-effective, mobile, adjustable, versatile, reliable and/or easy-to-use means for users to develop, strengthen, stretch, increase the flexibility of and/or rehabilitate, and to eliminate or reduce pain (if present) associated with, a wide variety of muscles and/or body parts, whether in a healthy condition or in an impaired condition, that may be easily manufactured and/or marketed.

The present invention provides an exercise sitting apparatus comprising:

(a) a platform having an upper side upon which a user may sit and a lower side;

(b) a turntable assembly including an upper plate having an upper side and a lower side, a turntable, an optional lower plate having an upper side and a lower side and one or more optional locking mechanisms, wherein the upper side of the upper plate is adjacent to the lower side of the platform, and wherein the turntable assembly provides the platform with an ability to partially or fully rotate independently of a slide plate assembly in a clockwise direction, a counterclockwise direction or in either direction when it is not maintained in a stationary position by a locking mechanism or other means;

(c) a slide plate assembly including an optional slide plate having an upper side and a lower side, one or more rollers, a track, a base plate having an upper side and a lower side and one or more optional locking mechanism, wherein the slide plate assembly has an ability to partially or fully rotate independently of the platform in a clockwise direction, a counterclockwise direction or in either direction when it is not maintained in a stationary position by a locking mechanism or other means;

(d) a supporting structure having an upper portion and a lower portion, wherein the supporting structure is adjacent to the lower side of the base plate of the slide plate assembly, and wherein the supporting structure provides support for the platform, the turntable assembly, the slide plate assembly, the user or any combination thereof; and (e) a base, wherein the base is adjacent to the lower portion of the supporting structure, and wherein the base has an ability to rest upon a floor in a manner that is relatively stable;

wherein the exercise sitting apparatus includes the lower plate of the turntable assembly, the slide plate of the slide plate assembly or both;

wherein, if the exercise sitting apparatus: (i) includes the lower plate of the turntable assembly, but not the slide plate of the slide plate assembly, the lower side of the lower plate of the turntable assembly is adjacent to the track of the slide plate assembly; (ii) includes both the lower plate of the turntable assembly and the slide plate of the slide plate assembly, the lower side of the lower plate of the turntable assembly is adjacent to the upper side of the slide plate of the slide plate assembly; and (iii) does not include the lower plate of the turntable assembly, but includes the slide plate of the slide plate assembly, the turntable is adjacent to the upper side of the slide plate of the slide plate assembly;

wherein the platform has an ability to travel from one location on the track of the slide plate assembly to another location on the track when the platform is not maintained in a stationary position on the track by a locking mechanism or other means; and wherein the exercise sitting apparatus permits a user to develop, strengthen, stretch, increase the flexibility of and/or rehabilitate one or more muscles or body parts.

In one preferred embodiment, the present invention provides an exercise sitting apparatus comprising:

(a) a platform having an upper side upon which a user may sit and a lower side;

(b) a turntable assembly including an upper plate having an upper side and a lower side, a turntable, a lower plate having an upper side and a lower side and one or more optional locking mechanisms, wherein the upper side of the upper plate is adjacent to the lower side of the platform, and wherein the turntable assembly provides the platform with an ability to partially or fully rotate independently of a slide plate assembly in a clockwise direction, a counterclockwise direction or in either direction when it is not maintained in a stationary position by the locking mechanism or other means;

(c) a slide plate assembly including a slide plate having an upper side and a lower side, one or more rollers, a track, a base plate having an upper side and a lower side and one or more optional locking mechanisms, wherein the upper side of the slide plate is adjacent to the lower side of the lower plate of the turntable assembly, and wherein the slide plate assembly has an ability to partially or fully rotate independently of the platform in a clockwise direction, a counterclockwise direction or in either direction when it is not maintained in a stationary position by the locking mechanism or other means;

(d) a supporting structure having an upper portion and a lower portion, wherein the supporting structure is adjacent to the lower side of the base plate of the slide plate assembly, and wherein the supporting structure provides support for the platform, the turntable assembly, the slide plate assembly, the user or any combination thereof; and (e) a base, wherein the base is adjacent to the lower portion of the supporting structure, and wherein the base has an ability to rest upon a floor in a manner that is relatively stable;

wherein the platform has an ability to travel from one location on the track of the slide plate assembly to another location on the track when the platform is not maintained in a stationary position on the track by a locking mechanism or other means; and wherein the exercise sitting apparatus permits a user to develop, strengthen, stretch, increase the flexibility of and/or rehabilitate one or more muscles or body parts.

DETAILED DESCRIPTION OF THE PREFERRED EMBODIMENTS

Figure 1:
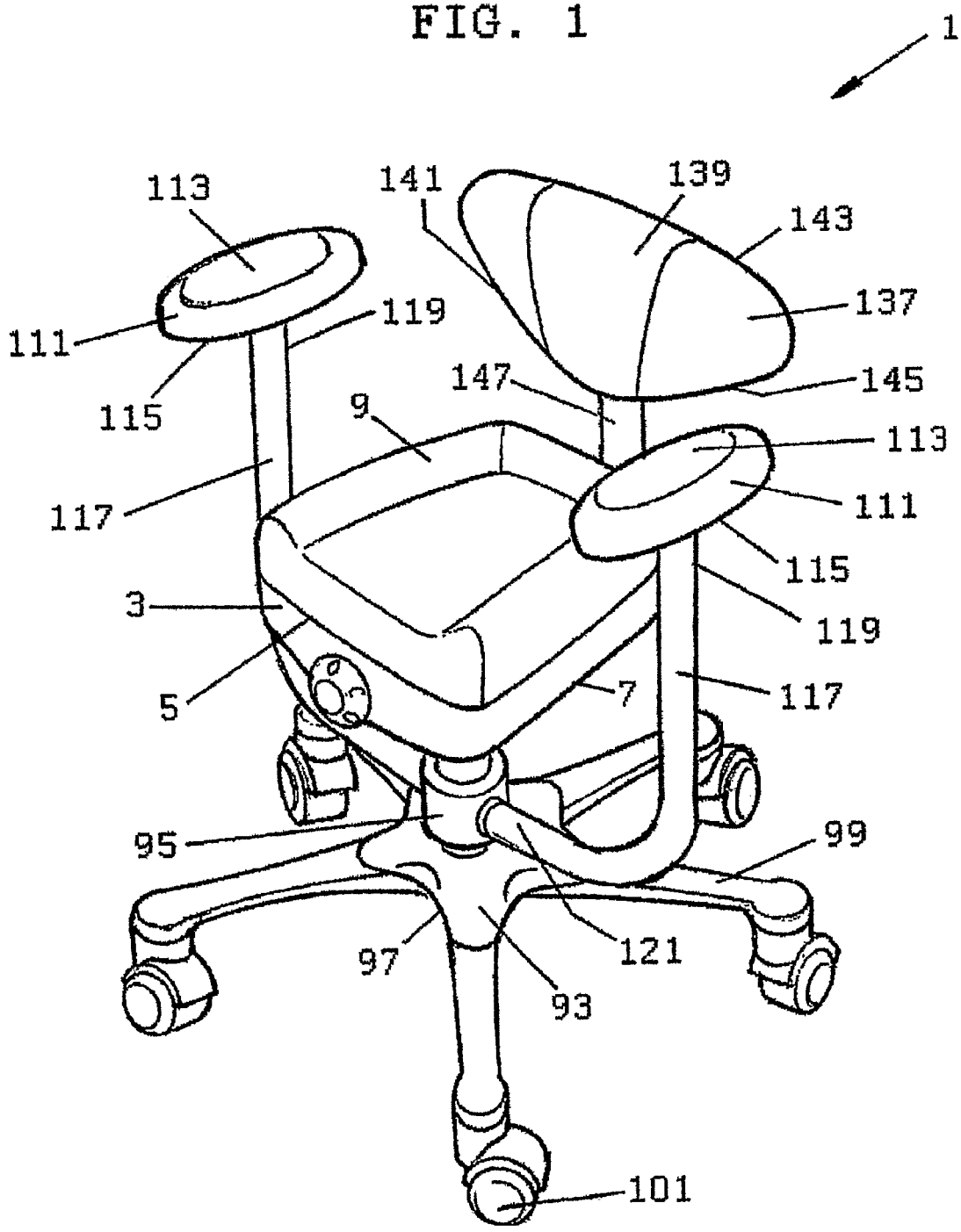
FIG. 1 is an illustration that shows a front view of an office chair configuration of the exercise sitting apparatus of the present invention. The base of this exercise sitting apparatus has rollers that permit the exercise sitting apparatus to travel, or roll, from one location to another location on a floor (or other suitable surface) in any direction.

The present invention may be understood more readily by reference to the following detailed description of the preferred embodiments of the invention.

Definitions

For purposes of clarity, various terms and phrases used throughout this specification and the appended claims are defined in the manner set forth below. If a term or phrase used in this specification, or in the appended claims, is not defined below, or otherwise in this specification, the term or phrase should be given its ordinary meaning.

The phrases "lower portion" or "lower side" as used herein in connection with various components of the exercise sitting apparatus of the invention means the area or side of the component that is closest to, or faces downwards towards, the floor or ground.

The term "plurality" as used herein means more than one, such as two, three, four, five, six, seven, eight, nine, ten, fifteen, twenty or the like.

The term "preferably" as used herein means that something is preferred, but is not required.

The term "rehabilitate" as used herein means to partially or fully restore a muscle, organ and/or body part to its former state of health and/or operation and/or to a normal health and/or function.

The phrase "relatively stable" as used herein in connection with a base means that the base is sufficiently stable (resistant to undesired motion and/or change of position and/or direction on a floor or other suitable surface) for permitting a user to conveniently and properly use an exercise apparatus of the present invention, and preferably is completely stable (generally not wobbly, shaky or otherwise unstable).

The phrases "upper portion" or "upper side" as used herein in connection with various components of the exercise sitting apparatus of the invention means the area or side of the component that is closest to, or faces upwards towards, the ceiling.

General Description and Utility

The present invention provides an exercise sitting apparatus that allows a user to develop, strengthen, stretch, increase the flexibility of and/or rehabilitate a wide variety of core and other muscles, such as the abdominal, lower back, external oblique, buttocks and/or hip flexor muscles, and the other muscles that are shown and/or described herein, and/or body parts, such as the neck, shoulders, back, hips, abdomen, legs and/or arms. Advantageously, such use will often result in an elimination or reduction of pain in a muscle and/or body part, if present.

The user of the exercise sitting apparatus of the invention may have, or be recovering from, a disease, illness, sports (or other) injury and/or muscle defect, deformity or impairment, for example, from an automobile or other type of an accident, or as a result of a back injury or a hip fracture, that causes muscle weakness and/or atrophy and, possibly, a limited range of motion. For example, the user may be an athlete, such as a long distance runner, that develops a stress fracture or shin splints in the foot or leg. In order to avoid future pain, such an athlete should ensure that the foot and leg muscles are stretched and supple, rather than hard and tight, when they have healed enough for the athlete to resume a sport. Such a result can be accomplished using the exercise sitting apparatus of the invention, preferably with the user's feet on the floor. As another example, the user may be an individual that has fractured his hip, or that has had a partial or full hip replacement surgery. In order to rehabilitate the hips, such an individual should strengthen the hip flexors, quadriceps and hamstrings, which can also be accomplished using the exercise sitting apparatus of the invention, preferably with the user's feet off of the floor. Alternatively, the user may be of an average or normal health and simply desire to develop, strengthen, stretch or increase the flexibility of his or her muscles, particularly core and other muscles, such as the abdominal, lower back, external oblique, buttocks and/or hip flexor muscles.

The exercise sitting apparatus of the invention can, very advantageously, be used virtually anywhere, such as in a home, a gym, a hospital, a medical clinic, a doctor's office, a chiropractor's office, a sports injury facility, a physical therapy facility, a back pain center, some other type of rehabilitative facility, a nursing home, a senior center or the like. Additionally, this apparatus can be very beneficial in an office setting. For example, an office chair configuration of the exercise sitting apparatus of the invention may permit the apparatus to be a multi-functional piece of office/fitness furniture that allows users to change their use of the apparatus between a sitting use (for the performance of their work) and an exercise use (to develop, strengthen, stretch, increase the flexibility of and/or rehabilitate one or more of a wide variety of muscles). Individuals who spend long hours sitting at their desk in a chair (or otherwise sitting, standing or the like) may, thus, almost instantaneously, and at right at their desk (or other convenience location), transform the exercise sitting apparatus from a standard type of an office chair to a high-tech, state-of-the-art fitness work out system, simply by using the apparatus in the manner described herein, or vice versa. Such a work out system permits such individuals to safely stretch, strengthen their muscles, increase their blood flow and recharge their body and/or mind while at work.

Advantageously, the exercise sitting apparatus of the present invention is typically mobile (unless it is desired to have the apparatus be non-mobile). If the base of the apparatus includes rollers or wheels, such as commercially available non-locking wheels or locking wheels (and the wheels are not locked), the apparatus can generally easily be rolled across a floor (or other support structure) and travel in any desired direction for any desired distance. Locking wheels typically can be locked (so that the wheels do not have an ability to roll or otherwise move) and unlocked (so that the wheels have an ability to roll) by exerting a pulling or pushing force upon a tab on the side of the wheels. If the apparatus does not include rollers or wheels, it can nevertheless generally be pulled across a floor (or other support structure) from one location to another location with a minimal amount of effort, such as a pulling or pushing force. The apparatus, thus, can generally easily be moved from one location to another, such as from a hospital or rehabilitative facility to a home, from a home to a car, from a home to an office, from the center of a room to a closet, and the like.

Also advantageously, the exercise sitting apparatus of the invention is typically susceptible of a relatively low cost of manufacture with regard to both materials and labor, rendering it susceptible to a relatively low sale price for the consuming public, thereby rendering the exercise sitting apparatus economically available to the purchasing public.

Specific exercise sitting apparatuses within the scope of the present invention include, but are not limited to, the exercise sitting apparatuses that are described herein and/or illustrated in the various drawings contained herein.

Contemplated equivalents of the exercise sitting apparatuses that are described herein and/or illustrated in the various drawings contained herein include exercise sitting apparatuses that that otherwise correspond thereto and/or have the same or similar characteristics, features, properties and/or components thereof, wherein one or more simple variations are made.

For the purpose of illustrating the exercise sitting apparatuses of the present invention, there are shown in the accompanying drawings, which form a material part of this disclosure, several different embodiments of the exercise sitting apparatuses that are presently preferred.

The various components of the exercise sitting apparatuses of the present invention are generally arranged in the manner that is shown in the drawings. However, the present invention is not limited to the precise arrangements, configurations, dimensions, components and instrumentalities that are shown in the drawings. These arrangements, configurations, dimensions, components and instrumentalities may be otherwise, as circumstances require, or as it is desired. Further, the invention is capable of other embodiments, and of being practiced and carried out in various manners. Also, it is to be understood that the phraseology and terminology employed herein are for the purpose of description, and should not be regarded as limiting in any manner.

Different specific embodiments of the exercise sitting apparatuses of the present invention will now be described with reference to the drawings. These drawings are merely illustrative, however, and should not be read as limiting the scope of the invention as it is claimed in the appended claims.

Figure 2:
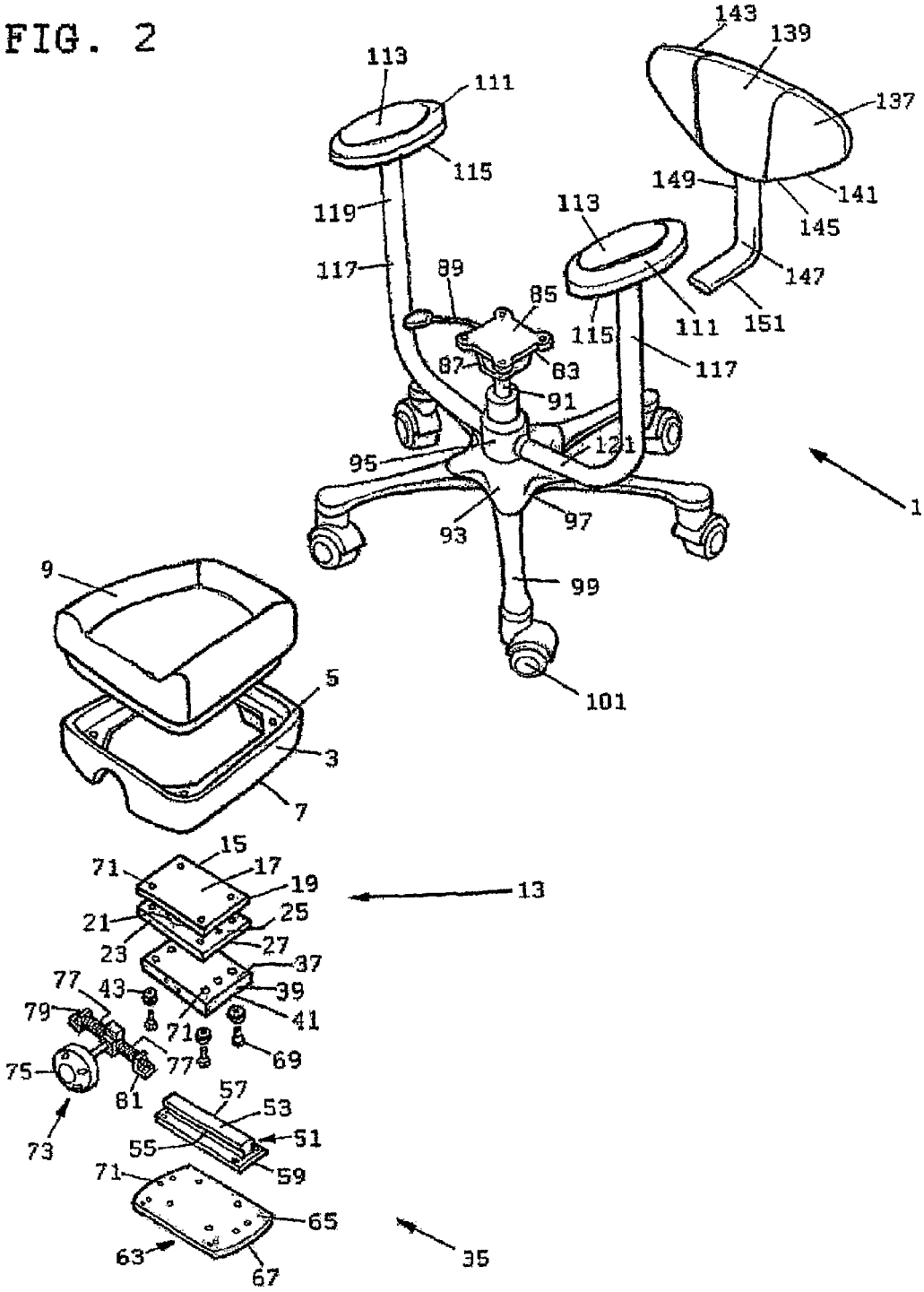
FIG. 2 is an illustration that shows the same exercise sitting apparatus that is shown in FIG. 1, with the exception that most of the parts of the exercise sitting apparatus 1 are detached.

The exercise sitting apparatus of the present invention may have a wide variety of different configurations, such as a chair configuration, an office chair configuration (as shown in FIGS. 1 and 2), an exercise configuration (as shown in FIGS. 3-7) or any other suitable configuration, which may readily be determined by those of ordinary skill in the art.

With reference to the drawings (FIGS. 1-14), a new exercise sitting apparatus that embodies the principles and concepts that are described herein are illustrated. The exercise sitting apparatus generally comprises a platform, a turntable assembly, a slide plate assembly, a supporting structure and a base. It, optionally, may also comprise one or more hand grips, arm rests, arm rest extensions, legs, rolling devices, back supports (and connecting devices), cushions (padding), pillows, restraining or supporting mechanisms (belts, straps, Velcro strips and the like), locking mechanisms, friction-reducing mechanism, tension mechanisms, release mechanisms, stop flanges, ratchet mechanisms, levers, knobs, brackets, plates, supports, attachment mechanisms, mounting mechanisms, sensors, motors, slots, holes and/or other desired components.

Figure 3:
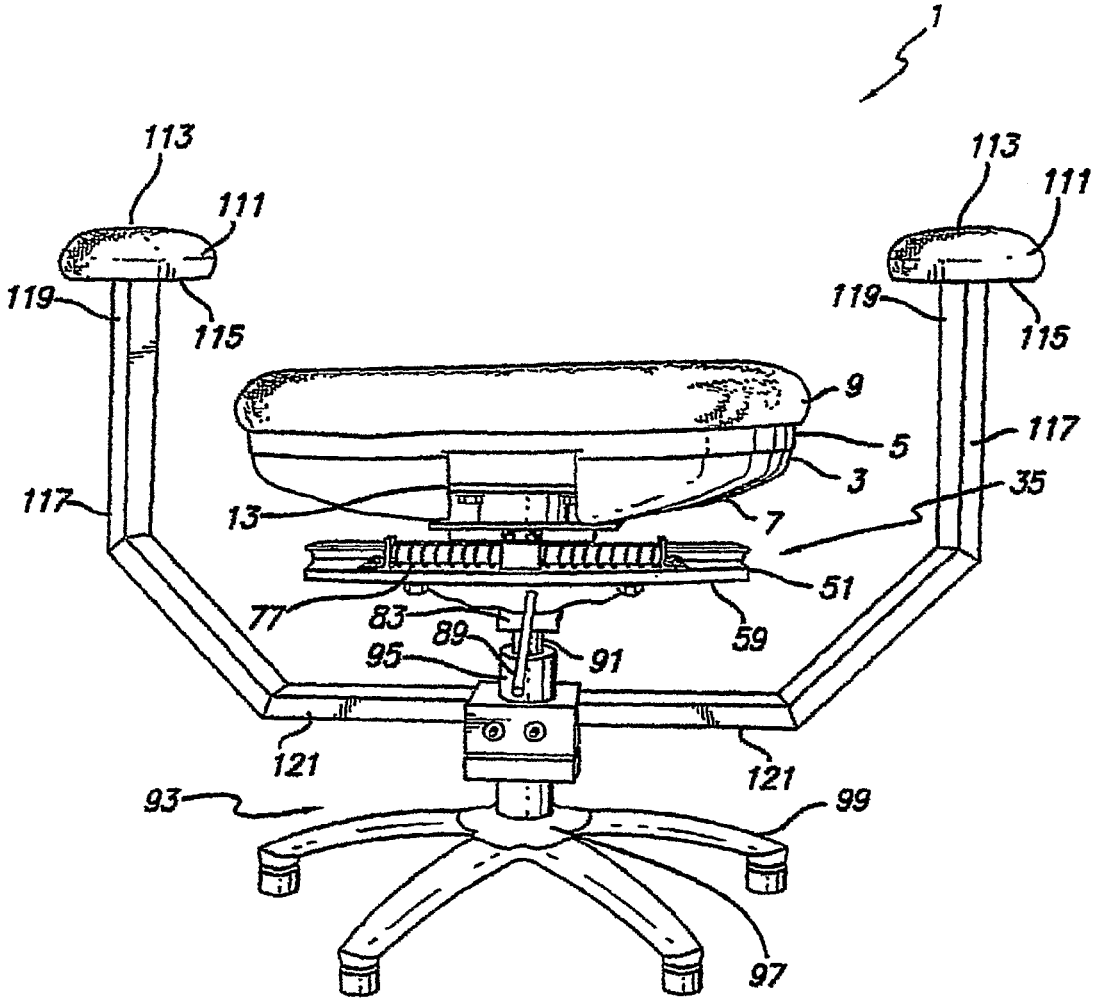
FIG. 3 is an illustration that shows a front view of an exercise sitting apparatus of the present invention that does not include rollers or a back support, but that can still slide or otherwise travel along a floor in any direction from one location to another location when a pulling or pushing force is exerted upon the apparatus.

FIGS. 1, 2 and 3 illustrate one preferred embodiment of the exercise sitting apparatus of the present invention 1, which has an office chair configuration. FIGS. 4, 5, 6 and 7 illustrate another preferred embodiment of the exercise sitting apparatus of the present invention 1, which has a configuration that provides an enhanced mobility and transportability.

Platform

The exercise sitting apparatus of the present invention 1 includes a platform 3, which may be, for example, a padded or non-padded, molded or non-molded, seat of virtually any type, or any other suitable structure for sitting, or resting a user's body (or part thereof). It generally has an upper side 5 (upon which a user may sit or rest) and a lower side 7.

The platform 3 may, optionally, include a padding 9 that functions to provide comfort for the user when using the exercise sitting apparatus 1, for example, a cushion, a pillow, a blanket (unfolded or folded in any suitable manner), a piece of foam rubber, or some other suitable material or device. The padding 9 may be either removably or permanently attached to, for example, the upper side 5 of the platform 3. In the embodiment of the exercise sitting apparatus 1 that is shown in FIG. 1, the platform 3 is a molded plastic seat having a cushion that is permanently attached to the upper side 5 of the platform 3, not unlike the portion of a conventional office chair upon which an individual sits.

In some embodiments of the exercise sitting apparatus of the invention 1, the platform 3 may, optionally, be movable in an upwards, downwards or other direction so that the apparatus may take a more compact form for travel and/or storage. In these embodiments, an optional release lever 11 (FIG. 7), or other suitable release and/or locking mechanism, many of which are known by those of skill in the art, may be employed to release the platform 3 in a manner that is transforms from a stationary (unmovable) position to a position in which it can move in an upwards, downwards or other direction. The release mechanism may be configured in a manner that the platform 3 can again be locked in any desired position (horizontally, upwards, downwards or the like) so that it does not move during transport or storage.

The platform 3 may be made of plastic, wood, metal, any other suitable material, or any combination thereof, and may be of any size (height, width and length) that permits it to function in the manner described and/or illustrated herein.

Turntable Assembly

A turntable assembly 13 (shown in detail in FIG. 12) including an upper plate 15 having an upper side 17 and a lower side 19, a turntable 21 and an optional lower plate 23 having an upper side 25 and a lower side 27 is also included in the exercise sitting apparatus 1 of the invention. In the embodiments of the invention that are shown in FIGS. 2 and 3, the upper side 17 of the upper plate 15 of the turntable assembly 13 is adjacent to the lower side 7 of the platform 3. The turntable assembly 13 functions to provide the platform 3 with an ability to partially (less than 360°) or fully (360°) rotate (independently of the slide plate assembly 35) generally about a partial or full horizontal plane or axis extending generally perpendicularly to the floor (or ground) in a clockwise direction, a counterclockwise direction or in either direction for one or a plurality of rotations when the turntable 21 and/or platform 3 are not maintained in a stationary position, for example, by an optional locking mechanism, or by an individual holding the platform 3 (or a part thereof) stationary.

Figure 10:
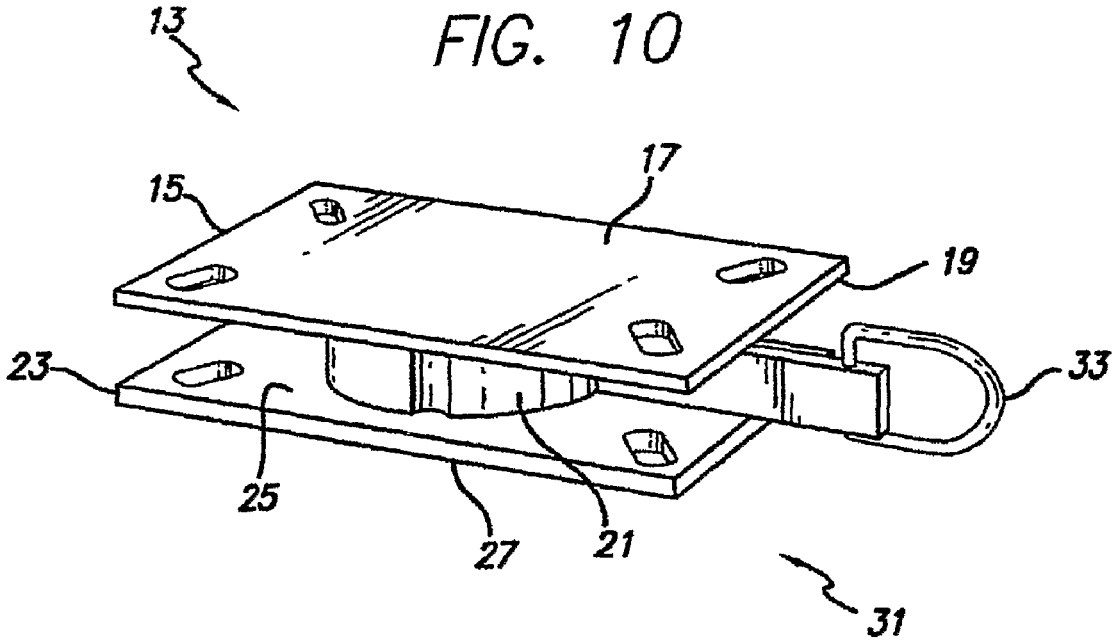
FIG. 10 is an illustration that shows two different turntable assemblies that may be employed in the exercise sitting apparatus of the invention, one of which is in a non-lockable form and the other of which is in a lockable form.
Figure 10:
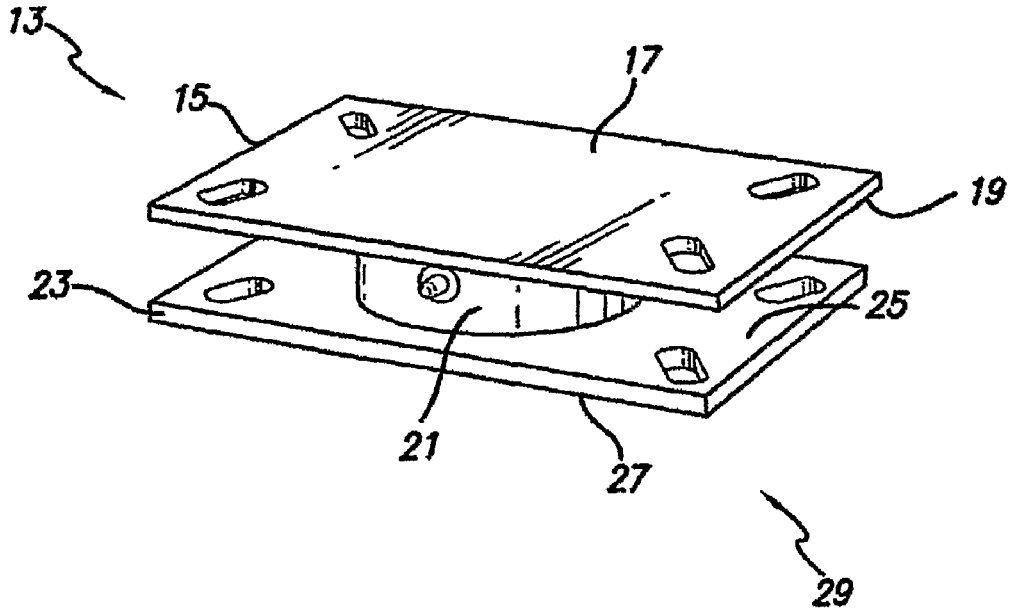

FIG. 10 shows two (of many) different turntable assemblies 13 that may, for example, be employed in the exercise sitting apparatus of the invention 1, one of which is in a non-lockable form 29, and the other of which is in a lockable form 31. The turntable assembly 13 may, optionally, include a locking mechanism for maintaining the turntable 21 in a locked (stationary) position, such as a spring loaded ring pull 33, as is shown in FIG. 10. When such a turntable 21 is locked, the platform 3 will generally no longer have an ability to partially or fully rotate in a clockwise and/or clockwise direction. The lockable form 31 of the turntable assembly 13 may have slotted grooves (not shown) in the center body that permit a user to lock the turntable assembly 13 into any of four evenly spaced positions using the spring-loaded ring pull 33. Non-lockable forms 29 of the turntable assembly 13 typically have a grease fitting (as shown in FIG. 10).

The lower plate 23 of the turntable assembly 13 is optional. If the exercise sitting apparatus 1 of the invention includes a slide plate 39 in the slide plate assembly 35, it need not (but still may) include the lower plate 23 of the turntable assembly 13. In this case, the upper side 37 of the slide plate 39 (rather than the upper side 25 of the lower plate 23 of the turntable assembly 13) may be adjacent to the turntable 21, and the slide plate 39 can function both as a slide plate and as a base for the turntable 21.

A wide variety of different turntable assemblies 13 are commercially available from sources that are known by those of skill in the art, for example, McMaster-Carr (Los. Angeles, Calif.). Many of these turntables are solid surface or ring style sloped turntables including a top having one diameter (such as 9") that slopes to a base having a larger diameter (such as 12") and a plurality of ball bearings (not shown) that ride in a precision-hardened raceway for smooth rotary motion. It is preferable that turntable assemblies 13 having steel plates employ steel ball bearings, and that turntable assemblies 13 having stainless steel plates include stainless steel ball bearings.

The turntable assembly 13 may be mounted or otherwise attached to the platform 3 (and to the slide plate assembly 35), or to another component of the exercise sitting apparatus 1, using, for example, glue, conventional welding techniques, bolts, such as standard Grade 5 or better hex-head bolts, captive screws or other conventional mounting hardware.

The turntable assembly 13, and various parts thereof, may be made of plastic, wood, metal, any other suitable material, or any combination thereof. It may be of any size (height, width and length) that permits it to function in the manner described and/or illustrated herein.

Slide Plate Assembly

Figure 11:
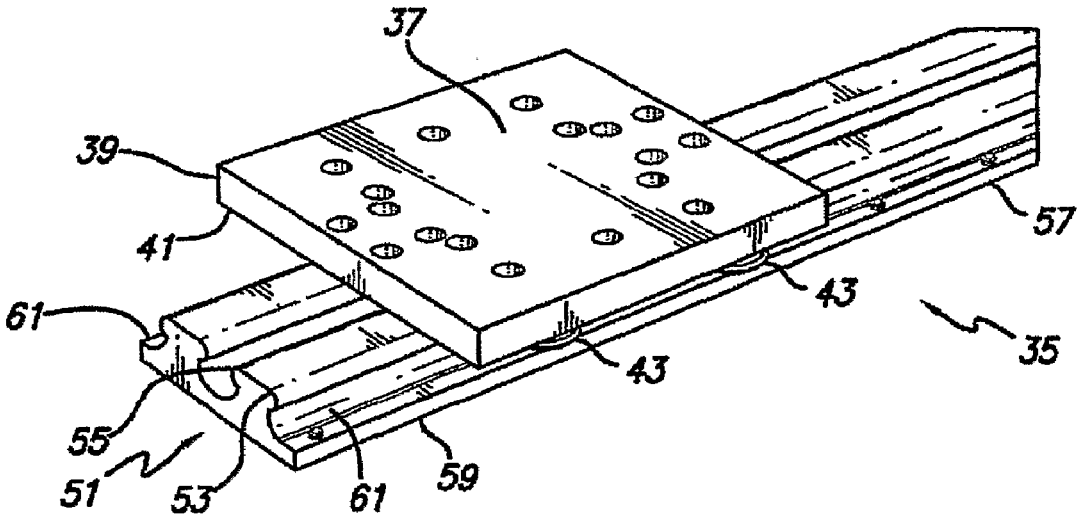
FIG. 11 is an illustration that shows a slide plate assembly including track roller guide blocks and rails that may be employed in the exercise sitting apparatus of the invention.
Figure 11:
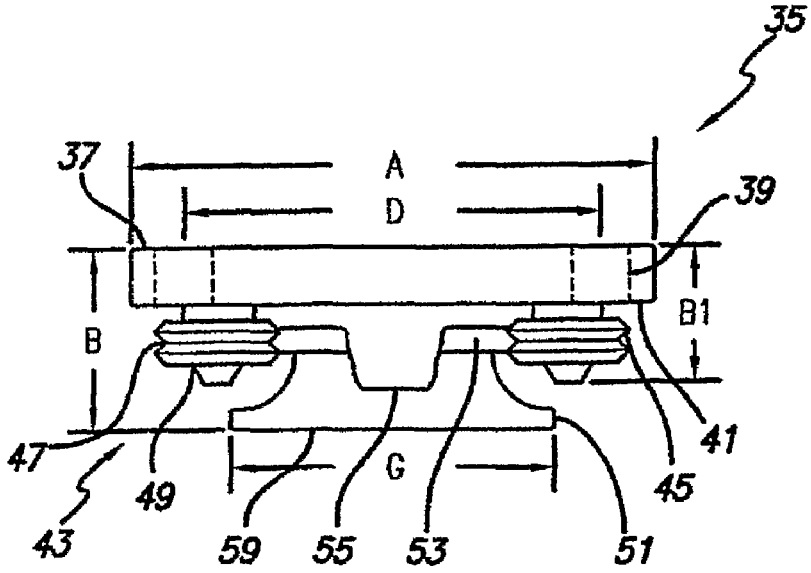
Figure 12:
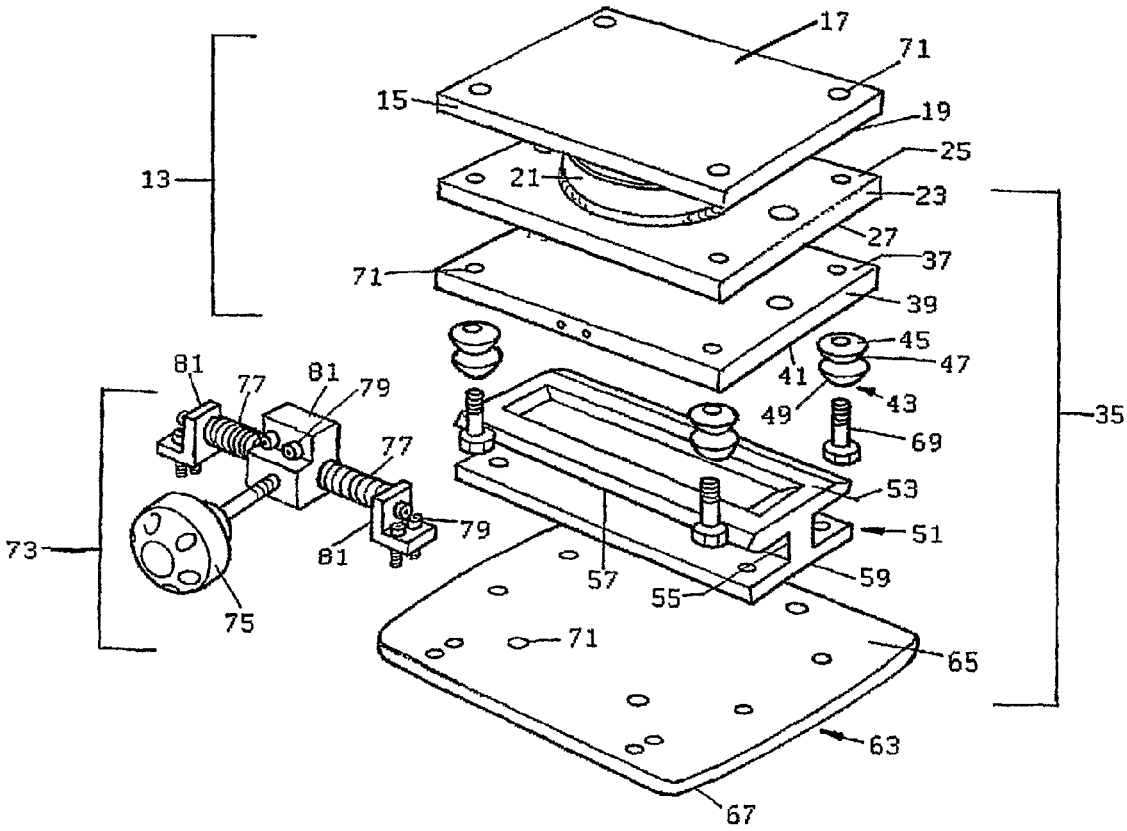
FIG. 12 is an illustration of a turntable assembly and a slide plate assembly that may be employed with the exercise sitting apparatus of the present invention, and shows their various component parts in a detached manner.

The exercise sitting apparatus 1 also includes a slide plate assembly 35 (shown in detail in FIGS. 11 and 12). The slide plate assembly 35 includes an optional slide plate 39 (having an upper side 37 and a lower side 41), one or more rollers 43 (having an upper portion 45, a center portion 47 and a lower portion 49), a track 51 (having an upper portion 53, a central portion 55, a center portion 57 and a lower portion 59), and a base plate 63 (having an upper side 65 and a lower side 67). When the slide plate 39 is present, the upper side 37 of the slide plate 39 preferably is adjacent to the lower side 27 of the lower plate 23 of the turntable assembly 13 (or to the lower side of the turntable 21 when the turntable assembly 13 does not include a lower plate 23).

The slide plate assembly 35 generally has an ability to partially (less than 360°) or fully (360°) rotate (independent of the turntable assembly 13) generally about a partial or full horizontal plane or axis extending generally perpendicularly to the floor (or ground) in a clockwise direction, a counterclockwise direction or in either direction for one or a plurality of rotations when the slide plate assembly 35 is not maintained in a stationary position, for example, by an optional locking mechanism (not shown) included in the slide plate assembly 35, or by an individual holding the slide plate assembly 35 (or a component thereof) stationary. Thus, both the platform 3 and the slide plate assembly 35 independently have an ability to make one or a plurality of full (360°) rotations in either a clockwise or a counterclockwise direction, or to be locked or otherwise maintained in a stationary position. One may be in a locked or stationary position while the other is not in a locked or stationary position, and vice versa, or both may be in a locked position (or otherwise maintained in a stationary position) or in an unlocked position. A user that is using the exercise sitting apparatus 1 for some type of rehabilitation may prefer to have one or both of the turntable assembly 13 and the slide plate assembly 35 in a locked position (so that only one of them, or neither of them, can rotate or otherwise move).

In addition to being partially or fully rotatable, the slide plate assembly 35 is preferably configured in a manner that the platform 3 has an ability to travel in a partial or full horizontal plane along the track 51 of the slide plate assembly 35 (from one end to the other end, or from one area on the track 51 to another area on the track 51, depending upon the amount of tension or resistance that may be present along the track 51 and/or whether or not one or more locking mechanisms are present along the track 51 or elsewhere), whether or not the platform 3 and/or the slide plate assembly 35 are fully or partially rotating, or are in a locked position and, thus, are stationary (or have only a limited possibility for movement). As is shown in FIG. 11, the rollers 43 are adjacent to the lower side of the slide plate 41, and fit within grooves 61 that are preferably present along the length of both sides of the track 51, thereby permitting the slide plate 39 (and turntable assembly 13 and platform 3) to slide back and forth along the track 51 from one location to another location.

If desired by the user, the platform 3 may be maintained in a stationary position on the track 51 (so that the platform 3 no longer has an ability to travel from one location to another location on the track 51) by using one or more suitable locking means for locking the platform 3 in place on the track 51, such as a pin (not shown) that is placed into a hole (not shown) located on the track 51, for example, at the center portion 57 of the track 51, or hydraulic, shock absorbing, braking, clamping or other device. Likewise, if desired by the user, the platform 3 may be adjusted (using one or more or a wide variety of locking or other mechanisms) in a manner that it may travel only for a predetermined distance along the track 51, with the predetermined distance being less than the full length of the track 51. This may be particularly advantageous for a user that is using the exercise sitting apparatus 1 for some type of rehabilitation. It may be beneficial for such a user to downwardly adjust the distance along the track 51 that the platform 3 may travel, for example, from two feet to one foot, from one foot to six inches, from six inches to two inches, and the like.

The slide plate assembly 35 may, optionally, and preferably, include one or more friction-reducing mechanisms (not shown), which may include one or more rollers or wheels, ball bearings and/or other suitable devices that enable the platform 3 to move in a horizontal direction partially, and preferably fully, along the length of the slide plate assembly 35 in a manner that is comfortable and suitable for the user. The amount of resistance provided by the friction-reducing mechanism is preferably large enough that the platform 3 does not slip easily from one end or portion of the slide plate assembly 35 to the other end or portion of the slide plate assembly 35 in a manner that renders the exercise sitting apparatus 1 difficult to manipulate or use, but not so large that the exercise sitting apparatus 1 becomes difficult to manipulate or use.

In some embodiments of the exercise sitting apparatus of the invention 1, the slide plate assembly 35 may, optionally, also include one or more mechanisms for increasing the tension in connection with an ability of the slide plate 39 (or lower plate 23 of the turntable assembly 13) to travel along the track 51, such as a tension mechanism 73 that includes a tension knob 75 and one or more springs 77. The tension mechanism 73 preferably permits a user to have an ability to position the platform 3 at a center portion 57 of the track 51, or at some other desired position, when no force, or a minimal force, is being applied to the platform 3 by the user. A user of the exercise sitting apparatus 1 that is undergoing some type of rehabilitation may, for example, prefer less tension (so that it is not as difficult to manipulate), whereas a healthy user that is using the apparatus 1 to strengthen muscles may, for example, prefer greater tension (to make the exercise more rigorous). Rubber bands, a cushioning member, or some other like mechanism may be employed in addition to, or in place of, the springs 77 in the tension mechanism 73. The tension knob 75 may be turned by a user in a manner known by those of skill in the art to increase resistance (from no tension to full tension, or any tension in between no tension and full tension), or decrease resistance (from full tension to no tension, or any tension in between full tension and no tension) in connection with the platform 3 traveling along the track 51 in a manner desired by the user.

FIG. 11 shows a commercially available precision, open, extra-width, horizontal-mount, V-groove track 51, aluminum roller guide blocks and rails, which are made of hardened and ground steel, that may, for example, be employed as the slide plate assembly 35 in the exercise sitting apparatus of the invention 1. These guide blocks are advantageously lightweight and easy to install. They have four external steel V-groove track rollers 43 that provide a lower coefficient of friction than ball bearings. The rollers 43 are lubricated and sealed for life, so the guides are suitable for dirty environments. The extra width, horizontal mount provides a higher rigidity and load capacity. Straightness accuracy is about 0.004" per inch of travel. The mount can also be side-mounted without affecting load capacity. The maximum temperature is 248° F., and the mount preferably has from six to eight threaded blind holes.

The turntable assembly 13 and/or slide plate assembly 35 (or components thereof) may, optionally, also include one or more holes 71 through which bolts 69 or 79 may be placed in order to attach various parts thereof together, or to attach various parts thereof to other components of the exercise sitting apparatus 1 of the invention. FIG. 12 shows a plurality of holes 71 through which bolts 69 may be inserted to attach the various components of the turntable assembly 13 together, the various parts of the slide plate assembly 35 together or the slide plate assembly 35 to the turntable assembly 13. FIG. 12 also shows a plurality of bolts 79 that can be employed to attach mounting brackets 81 that are present on the tension mechanism 73 with the slide plate assembly 35.

The slide plate assembly 35 may, optionally, include one or more conventional (or other) locking mechanisms (not shown) that may permit: (i) the slide plate assembly 35 to be fixed in a specified or desired position and/or remain stationary (have an inability to partially or fully rotate); and/or (ii) the platform 3 to be in a specified or desired position on the track 51 of the slide plate assembly 35 and/or remain stationary (have an inability to move to any other location along the track 51). The locking mechanism may be configured in a manner that prevents, or reduces the ability of, the slide plate assembly 35 from rotating when the locking mechanism is activated. In contrast, when the locking mechanism is deactivated, the slide plate assembly 35 may again rotate more, or completely, freely in either a clockwise or counterclockwise direction (with a possibility of having a plurality of full (360°) rotations in either direction). Additional locking mechanisms may, optionally, also be included in the exercise sitting apparatus 1 of the present invention.

The slide plate 39 (the component, but not its function) of the slide plate assembly 35 is optional. If the exercise sitting apparatus 1 of the invention includes a lower plate 23 of the turntable assembly 13, it need not (but still may) include the slide plate 39. In this case, the lower plate 23 of the turntable assembly 13 (rather than the slide plate 39) may be adjacent to the track 51, and may function both as a base for the turntable 21 and as a slide plate in the slide plate assembly 35 (to slide along the length of the track 51, when desired).

A wide variety of different slide plate assemblies 35 are commercially available from sources that are known by those of skill in the art, for example, Bishop Wisecarver (Pittsburg, Calif.) and McMaster-Carr (Los Angeles, Calif.).

The slide plate assembly 35 may be mounted or otherwise attached to the turntable assembly 13, or to another component of the exercise sitting apparatus 1, using, for example, glue, conventional welding techniques, bolts, such as standard Grade 5 or better hex-head bolts, captive screws or other conventional mounting hardware.

The slide plate assembly 35, and various parts thereof, may be made of plastic, wood, metal, any other suitable material, or any combination thereof. It may be of any size (height, width and length) that permits it to function in the manner described and/or illustrated herein.

Supporting Structure

The supporting structure 83 may take a wide variety of forms, such as a flat (or other shaped) piece of metal of any suitable size, but should permit the lower side of the base plate 67 to preferably be permanently or detachably mounted to the upper portion of the supporting structure 85 in a manner that the slide plate assembly 35 and the supporting structure 83 each have an ability to partially or fully rotate (from 0° to 360° and with each other), unless in a locked position, and should not impede the use or the functionality of the exercise sitting apparatus 1 (or any part thereof). If suitable, the supporting structure 83 may be a standard supporting structure that is customarily employed in a conventional office or other chair.

The supporting structure 83 may, optionally, be upwardly or downwardly adjustable in a manner that permits the platform 3 to be raised or lowered (manually or otherwise), so as to accommodate, and provide comfort and ease of use, for users of different sizes and/or heights. As is shown in FIG. 3, the exercise sitting apparatus 1 may have a hydraulic (or other) lever 89, or other suitable means, included therein for permitting the supporting structure 83 to be hydraulically, manually or otherwise adjusted upwards and/or downwards. Other devices that are suitable for making such adjustments are those that are conventionally present in exercise and regular bicycles.

Base

The supporting structure 83 preferably has its lower portion 87 attached to any type of a suitable base 93 that preferably provides an overall stability to the exercise sitting apparatus 1, and that has an ability to sit or rest on the floor (or upon some other structure).

As is shown in FIGS. 1, 2 and 3, the base 93 may have an upper portion 95 and a lower portion 97 and a rod 91 that is adjacent to the lower portion of the supporting structure 87. Although the rod 91 is preferably stationary (does not have an ability to rotate), the supporting structure 83 preferably contains a plurality of ball bearings (or another suitable mechanism) that permit the supporting structure 83 to partially or fully rotate in a clockwise and/or counterclockwise direction, even though it is adjacent to a stationary rod 91. Alternatively, the rod 91 may be fixably rotatable so that it has an ability to partially or fully rotate (and not be stationary) unless it is in a locked position, for example, using some type of conventional of other locking mechanism. For example, the lower end of the rod 91 could be mounted onto an optional additional turntable assembly (not shown), thereby permitting the rod 91 to rotate in the manner described hereinabove for the turntable assembly 13. Alternatively, the rod 91 could be placed adjacent to one or more ball bearings that permit such rotation.

The base 93 may be permanently or removably attached to a floor (or other support), or may simply sit or rest on the floor, and may include one or more legs 99, feet and/or rolling devices 101 (non-lockable or lockable), such as wheels or rollers, which permit the exercise sitting apparatus 1 to be easily moved across a floor (when lockable wheels are not locked), like a conventional office chair, and which are preferably downwardly depending.

As is shown in FIGS. 4, 5, 6 and 7, the base 93 may, alternatively, comprise a tapered leg frame 103 that may, optionally, be folded or collapsed for compactness and/or storage (FIG. 7), or a leg frame that is in a non-tapered form. A two-way locking mechanism 107 (FIG. 4), a frame pivot point release mechanism 109 (FIGS. 5, 6 and 7), or other locking and/or release means, many of which are known by those of skill in the art, may be employed to lock the tapered leg frame 103 in an open position, a collapsed position or in some other desired position. For example, the exercise sitting apparatus 1 may be: (i) locked in an open position when a locking mechanism or release means is locked, and folded in a collapsed position when the locking mechanism or release means is unlocked; (ii) in an open position when a locking mechanism or release means is unlocked, and folded in a collapsed position when the locking mechanism or release means is locked; or (iii) locked into both an open position and a collapsed position.

Figure 4:
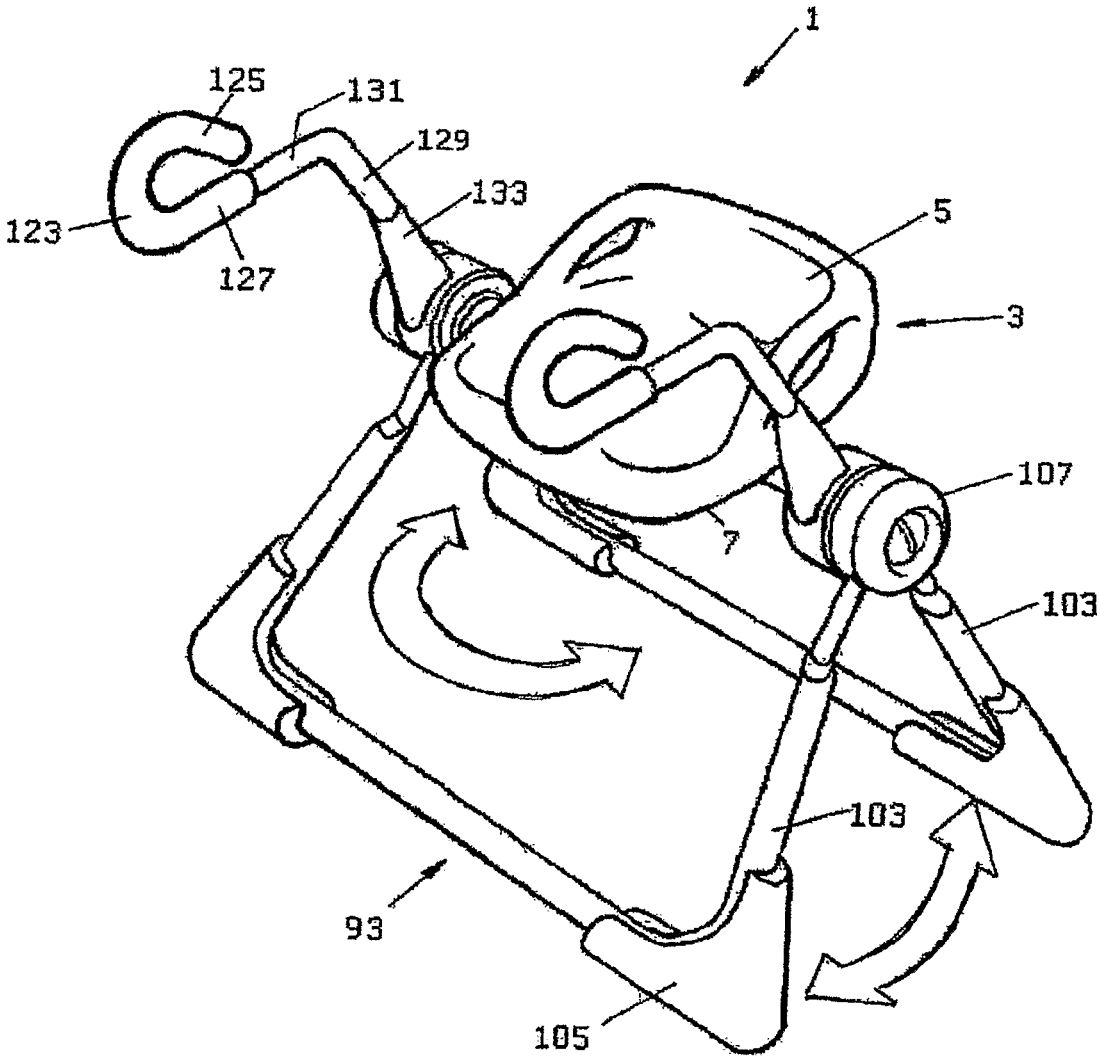
FIG. 4 is an illustration that shows a front view of an exercise sitting apparatus of the present invention that has a molded plastic platform (seat) with a back, stationary frontwardly extending arm rests with foam cushioned hand grips, a tapered leg frame that conveniently folds for easy storage and has leg corners made of hard rubber, and a two-way lock mechanism that functions to lock the tapered leg frame in either an open or collapsed (folded) position.

As is shown in FIG. 4, leg corners 105 that may be made of a hard rubber, or of another suitable material, may, optionally, be placed on one or more of the corners of the tapered leg frame 103 to provide additional stability to, and prevent slippage of, the exercise sitting apparatus 1.

Figure 8:
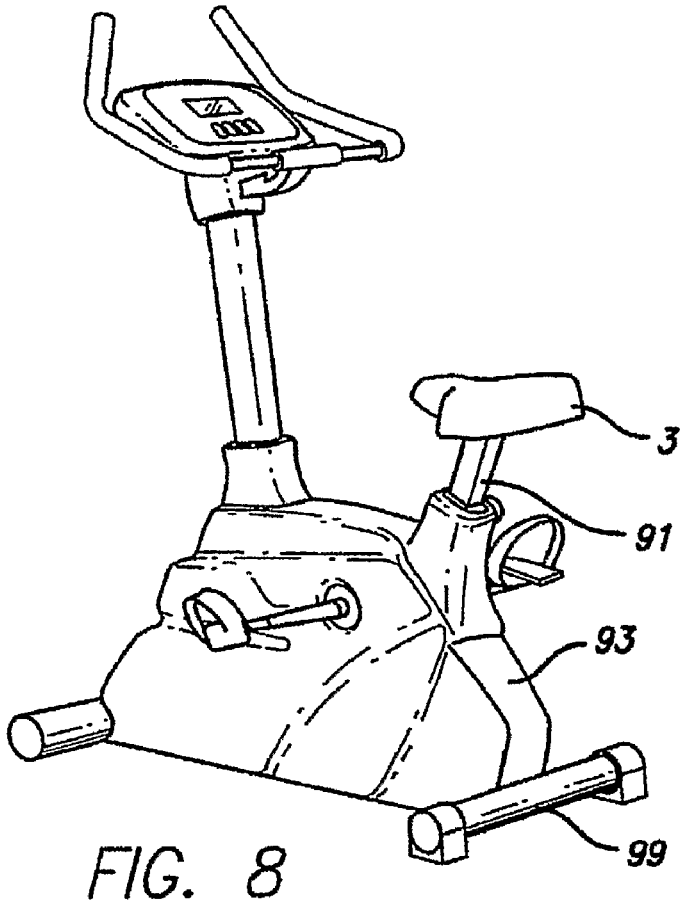
FIG. 8 is an illustration of a conventional stationary exercise bicycle, and shows a different base, seat and other components that can be employed with the exercise sitting apparatus of the present invention.
Figure 9:
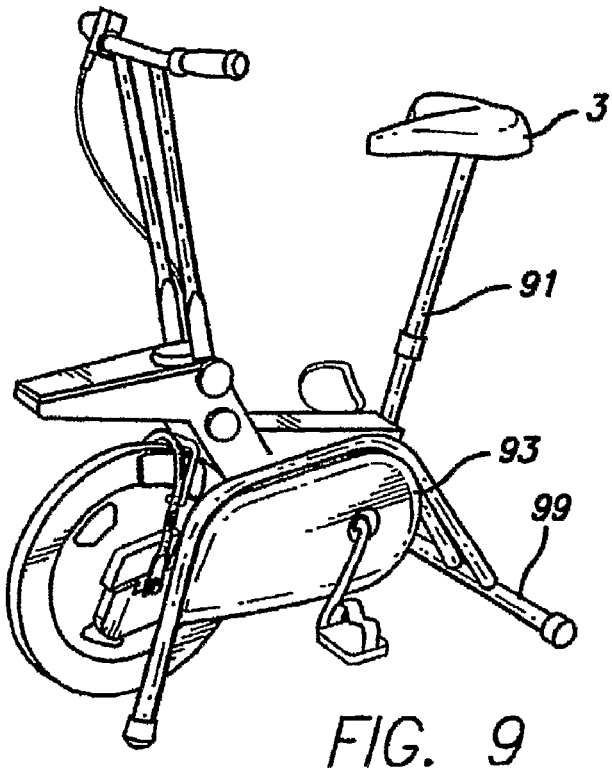
FIG. 9 is an illustration of another conventional stationary exercise bicycle, and also shows a different base, seat and other components that can be employed with the exercise sitting apparatus of the present invention.

FIGS. 8 and 9 each show a platform, base and poll that are present in two different conventional stationary exercise bicycles. Such components may also be employed as the platform 3, base 93 and rod 91 in the exercise sitting apparatuses 1 of the invention.

Arm Rests

As is shown in FIGS. 1, 2 and 3, the exercise sitting apparatus of the invention 1 may, optionally, include one, two or more arm rests 111, each of which may have an upper portion 113 and a lower portion 115. Each arm rest 111 is preferably upwardly and/or downwardly adjustable, and inwardly and/or outwardly adjustable (in a manner that permits it to become wider or narrower), so that the exercise sitting apparatus 1 may accommodate, and be comfortable for, various types and sizes of users. A wide variety of mechanisms are known by those of skill in the art for making such adjustments, such as hydraulic levers (not shown).

If one or more arm rests 111 are included in the exercise sitting apparatus 1, each arm rest 111 will preferably have one or more extensions 117 that connect the arm rest 111 with the base 93 (or other portion) of the exercise sitting apparatus 1. Each extension 117 will preferably have an upper portion 119 and a lower portion 121, with the upper portion 119 being permanently or removably attached to the lower portion 115 of the arm rest 111, and the lower portion 121 being permanently or removably attached to the base 93 (at any suitable or convenient location thereof). The extensions 117 may be of any suitable length and shape that permit the arm rests 111 to be attached to the base 93 (or other portion of the exercise sitting apparatus 1), and the user to be comfortable when using the exercise sitting apparatus 1, and are also preferably upwardly and/or downwardly adjustable, and adjustable in a manner that permits them to become wider or narrower.

Hand Grips

As is shown in FIGS. 4, 5, 6 and 7, the exercise sitting apparatus of the invention 1 may, optionally, or alternatively to arm rests 111, include one, two or more hand grips 123, handlebars or the like, each of which may have an upper portion 125 and a lower portion 127. The handgrips 123 may include thereon a material that renders them comfortable for use by a user, such as foam or rubber. Each handgrip 123 is also preferably upwardly and/or downwardly adjustable, and inwardly and/or outwardly adjustable (in a manner that permits it to become wider or narrower), so that the exercise sitting apparatus 1 may accommodate, and be comfortable for, various types and sizes of users. A wide variety of mechanisms are known by those of skill in the art for making such adjustments, such as hydraulic levers (not shown).

If one or more handgrips 123 are included in the exercise sitting apparatus 1, each handgrip 123 will preferably have one or more extensions 129 that connect the handgrip 123 with the base 93 (or other portion) of the exercise sitting apparatus 1. Each extension 129 will preferably have an upper portion 131 and a lower portion 133, with the upper portion 131 being permanently or removably attached to the lower portion 127 of the hand grip 123, and the lower portion 133 being permanently or removably attached to the base 93 (at any suitable or convenient location thereof). The extensions 129 may be of any suitable length and shape that permit the hand grips 123 to be attached to the base 93 (or other portion of the exercise sitting apparatus 1), and the user to be comfortable when using the exercise sitting apparatus 1, and are also preferably upwardly and/or downwardly adjustable, and inwardly and/or outwardly adjustable (in a manner that permits them to become wider or narrower).

Figure 5:
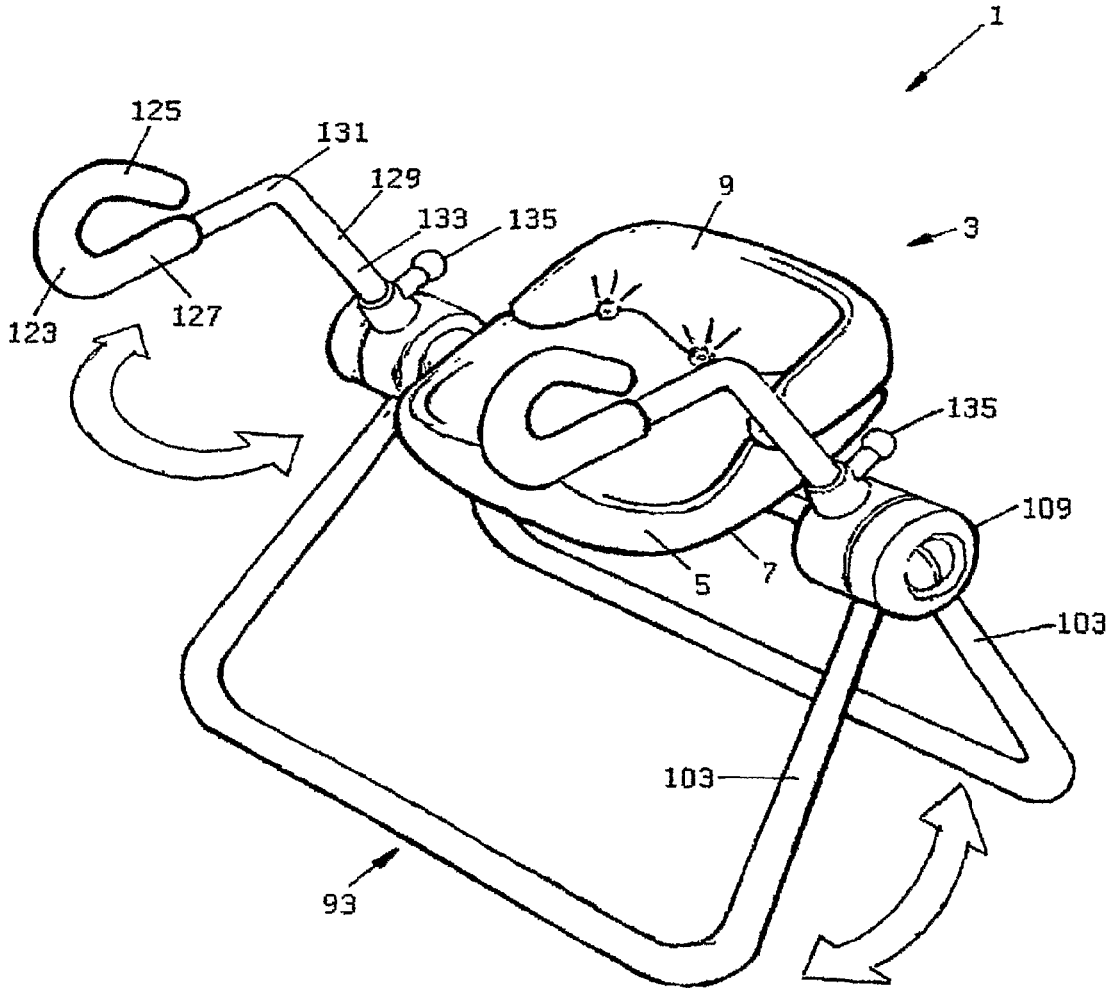
FIG. 5 is an illustration that shows a similar exercise sitting apparatus to that shown in FIG. 4, with the exceptions that: (i) the arm rest extensions can partially or fully (360°) rotate; (ii) spring pin release mechanisms that can lock the arm rest extensions, or permit them to partially or fully rotate, are present; (iii) a vinyl seat cushion is present on top of the platform; (iv) a frame pivot point release mechanism that allows the leg frame to be locked in an open position and, when released, to be folded into a collapsed position is present; and (v) the leg frame is a tapered mandrel formed bent tubing frame.
Figure 6:
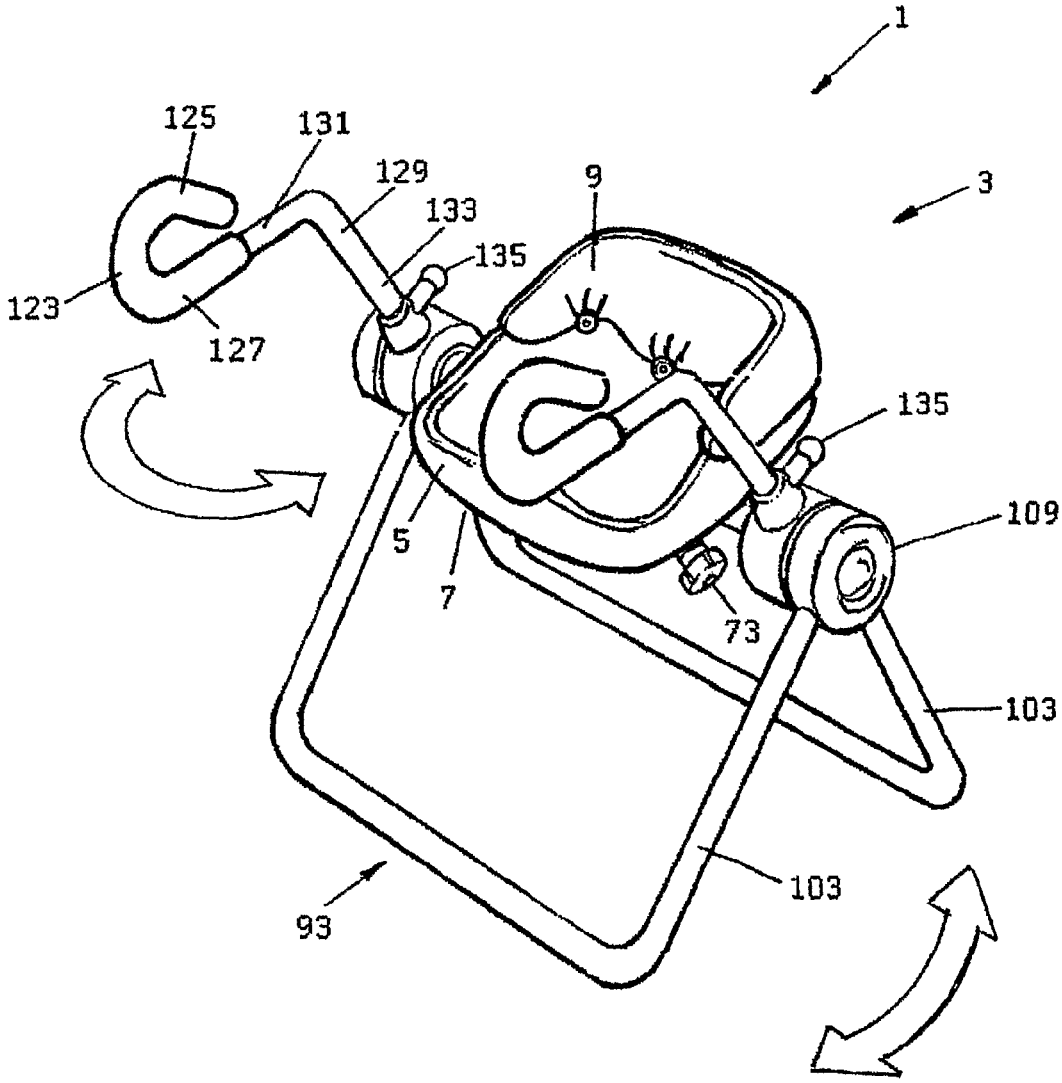
FIG. 6 is an illustration that shows a similar exercise sitting apparatus to that shown in FIG. 5, with the exception that the exercise sitting apparatus includes a tension mechanism that increases resistance in connection with the platform sliding from one location to another location along the track of the slide plate assembly.
Figure 7:
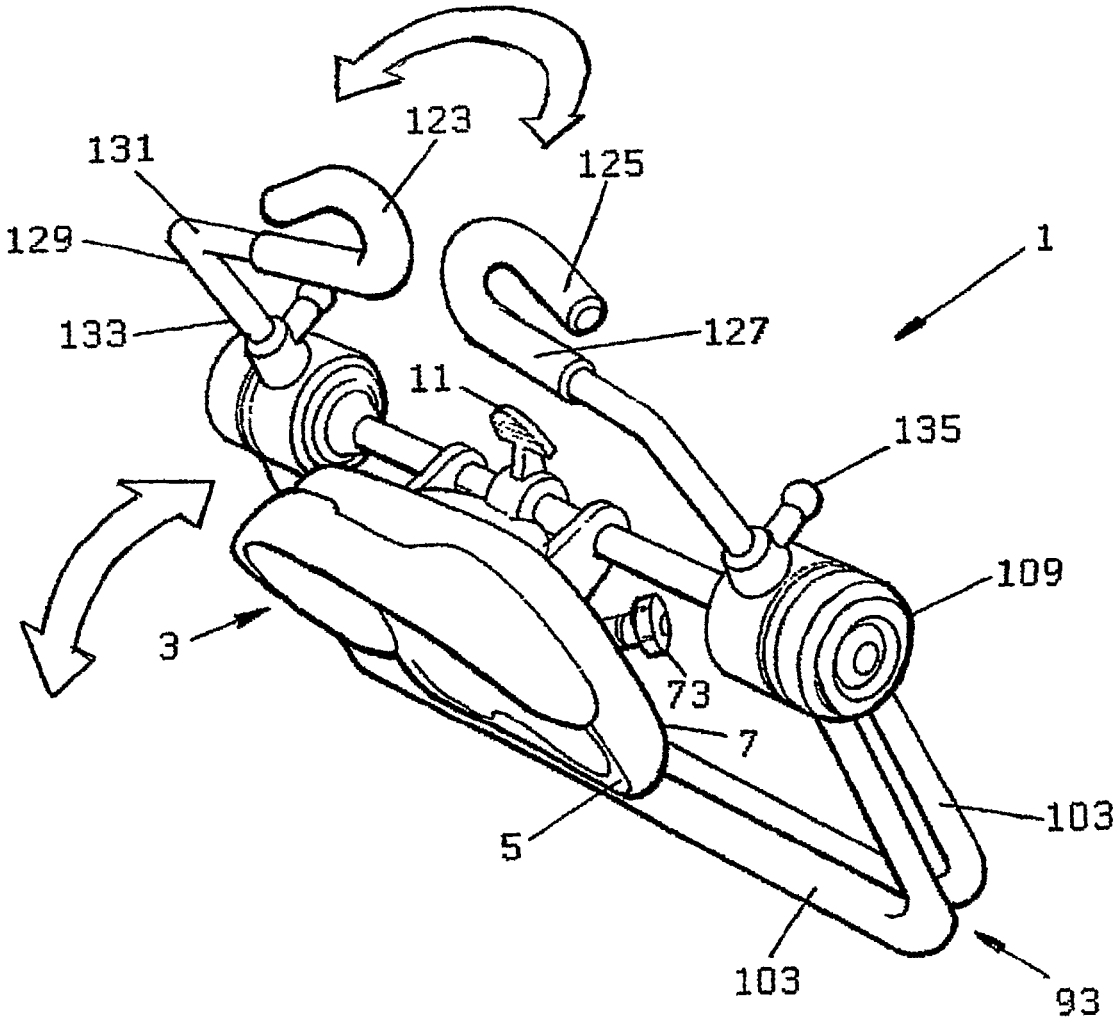
FIG. 7 is an illustration that shows the same exercise sitting apparatus that is shown in FIG. 6, with the exception that the exercise sitting apparatus is folded (collapsed) in a manner that renders it convenient for storage and/or transportation in a suitable place, such as a closet or car, and smaller in size (thinner and/or shorter) in comparison with the same exercise sitting apparatus that is in a non-folded or non-collapsed configuration.

In some embodiments of the invention, as is shown in FIGS. 5 and 6, the hand grips 123 (or arm rests 111) may, optionally, have an ability to partially (less than 360°) or fully (360°) rotate in a clockwise, counterclockwise and/or other direction, and/or as is shown in FIG. 7, may have an ability to be collapsed or folded upwards, downwards or in another direction into a partial or fully collapsed position (to make them more compact and save space for travel and/or storage). An optional spring pin release mechanism 135 (FIGS. 5, 6 and 7), or other suitable release means, may be included in the exercise sitting apparatus 1, for example, at the lower portion of the extension 133, for releasing the hand grips 123 and extensions 129 and transforming their position from a stationary (non-movable) position to a rotatable position.

Back Support

As is shown in the embodiment of the exercise sitting apparatus 1 that is illustrated in FIGS. 1 and 2, but not in the embodiment that is illustrated in FIG. 3, a back support 137 may, optionally, also be included in the exercise sitting apparatus 1 of the invention. The back support 137 can function to provide support for the back of the user, and preferably has a front portion 139 (the portion upon which a user may rest his back), a back portion 141 (a portion that faces away from the user), an upper portion 143 and a lower portion 145.

The back support 137 may, optionally, include, a headrest (not shown), a neck rest or the like, or may be omitted altogether. If a back support 137 is included in the exercise sitting apparatus 1, it will preferably have a connecting device 147 that connects the back support 137 with the platform 3 (or other portion) of the exercise sitting apparatus 1. The connecting device 147 will preferably have an upper portion 149 and a lower portion 151, with the upper portion 149 being permanently or removably attached to the lower portion 145 of the back support 137, and the lower portion 151 being permanently or removably attached to the platform 3 (at any suitable or convenient location thereof) or other portion of the exercise sitting apparatus 1. The connecting device 147 may be of any suitable length and shape that permits the back support 137 to be mounted or otherwise attached to the platform 3, base 93, supporting structure 83 or other part of the exercise sitting apparatus 1, or may be mounted in some other fashion altogether. The connecting device 147 is also preferably upwardly and/or downwardly adjustable, adjustable in a manner that permits it to become wider or narrower, and forwardly and backwardly adjustable (movable towards, and away from, the user), thereby permitting the back support 137 to be placed in a position (in relation to the back of other body part of the user) that is comfortable for the user, or to be distanced from the user (so that the user does not need to use the back support 137 at all). The exercise sitting apparatus 1 may, thus, accommodate, and make comfortable, various types and sizes of users. Mechanisms for achieving such adjustments, such as manual, hydraulic and other lifts (not shown), are known by those of skill in the art.

A conventional lap belt, seat belt or other securing means (not shown) may be included in the exercise sitting apparatus 1, which may permit the user to secure himself to the platform 3 or to some other part of the exercise sitting apparatus 1. Such a securing means may be particularly desirable for a user that has a stability that is less than normal (for the particular user or in comparison with healthy individuals), for example, a user that has a degenerative disease, such as Parkinson's Disease or Amyotrophic Lateral Sclerosis, or that is recovering from an illness, surgery or an accident.

Seat Bowl Assembly

Figure 13:
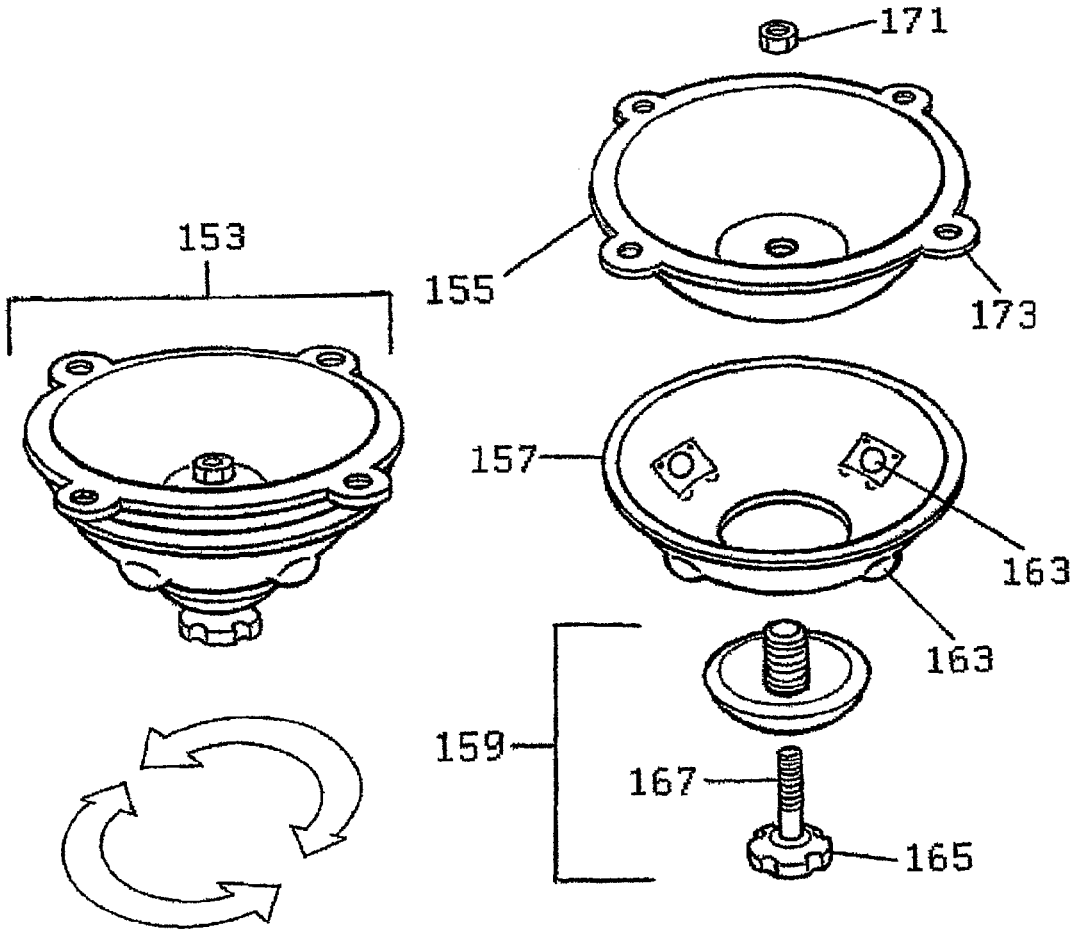
FIG. 13 is an illustration of a seat bowl assembly that may be used in place of, or in addition to, the turntable assembly in another embodiment of the exercise sitting apparatus of the invention.
Figure 14:
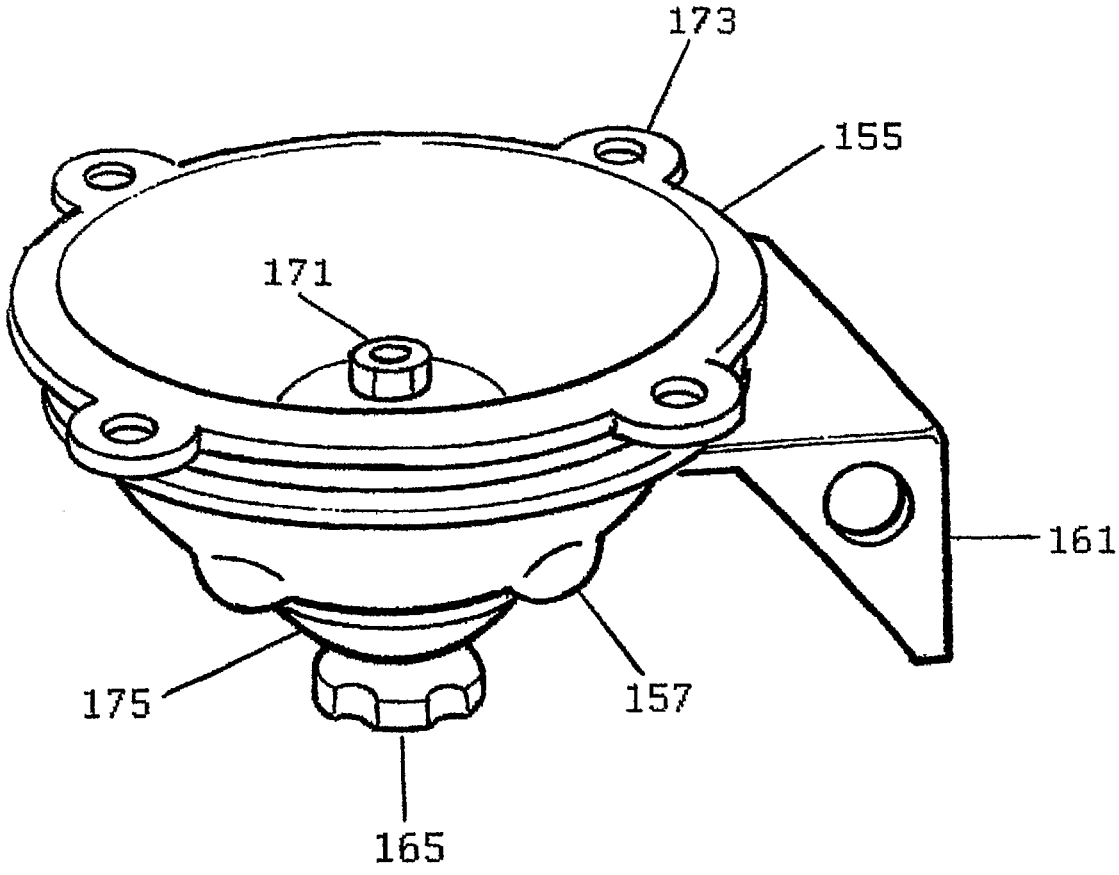
FIG. 14 is an illustration that shows the same seat bowl assembly that is shown in FIG. 13, with the exception that the seat bowl assembly includes a seat mount bracket (for attaching the seat bowl assembly to the base).

FIGS. 13 and 14 illustrate a seat bowl assembly 153 that may be employed in other embodiments of the sitting exercise apparatus 1 of the present invention. In these embodiments, the seat bowl assembly 153 may be employed in place of the turntable assembly 13, and may be employed with or without a slide plate assembly 35. It also functions to permit the platform 3 to partially (less than 360°) or fully (360°) rotate in a clockwise and/or counterclockwise direction when it is not locked by some type of a locking means.

The seat bowl assembly 153 may include a first seat bowl 155 having an opening in its center for receiving a threaded portion 167 of a tension knob 165, a second seat bowl 157 having an opening in its center for receiving a threaded portion 167 of a tension knob 165, a tension assembly 159 and a seat mount bracket 161 (for mounting the seat bowl assembly 153 to the platform 3 or other component of the sitting exercise apparatus 1, as is shown in FIG. 7). The upper portion 173 of the seat bowl assembly 153 may be attached to the lower side 7 of the platform 3. The seat mount bracket 161 that is shown in FIG. 14 is suitable for use with the embodiment of the exercise sitting apparatus 1 that is illustrated in FIG. 7. However, other mounting brackets and/or hardware may be employed to connect the seat bowl assembly 153 to other embodiments of the exercise sitting apparatus 1, such as the embodiment shown in FIG. 1. The first seat bowl 155 rests within the second seat bowl 157 and, unless locked by a conventional or other locking mechanism or held stationary, is permitted to rotate partially or fully (360°) therein as a result of four (or some other suitable number of) ball bearings that sit (individually) within four separate bearing well areas 163 that are present in the inside of the second seat bowl 157.

The tension assembly 159 preferably includes a tension knob 165 having a threaded portion 167 at one end, a small bowl 169 having an opening for receiving the threaded portion of the tension knob 165 and a nut 171 that may screw onto the threaded portion of the tension knob 165 and hold the seat bowl assembly together when the threaded portion of the tension knob 165 is inserted into the holes of the first seat bowl 155 and second seat bowl 157 (as is shown in FIG. 14). Other methods for providing tension between the first seat bowl 155 and the second seat bowl 157 are known by those of skill in the art, and are included in the exercise sitting apparatus of the invention 1.

While the embodiments of the exercise sitting apparatus that are shown in FIGS. 1 and 2 employ an office chair-type configuration, the present invention is in no way limited to an office chair-type configuration. Other embodiments of the exercise sitting apparatus 1 are illustrated, for example, in FIGS. 3, 4, 5, 6 and 7. All of these and other embodiments of the exercise sitting apparatus may generally be used in a home, a gym, a hospital, a medical clinic, a doctor's office, a chiropractor's office, a sports injury facility, a physical therapy facility, a back pain center, some other type of rehabilitative facility, a nursing home, a senior center or the like.

Also, while the embodiment of the exercise sitting apparatus that is illustrated in FIGS. 1 and 2 is in the context of a chair or seating apparatus, the platform of the exercise sitting apparatus may be any suitable supporting structure upon which a user can sit, with the other parts of the exercise sitting apparatus being employed with, or mounted onto, the supporting structure.

The exercise sitting apparatus of the present invention is not limited to an office chair configuration or to a chair configuration. For example, the various parts of the exercise sitting apparatus may be employed with, or mounted upon, the seat, base or other portion of a conventional or other stationary exercise bike in lieu of a traditional seat. In such an embodiment, the slide plate could be mounted rotatably to the seat post of an exercise bike, and the platform could be mounted rotatably to the slide plate to achieve the desired range of movements. In this embodiment, the supporting structure could be the exercise bike itself (those parts that are located below the slide plate). Other embodiments may employ different supporting structures altogether.

As is shown in FIG. 7, the exercise sitting apparatus of the invention may, optionally, be configured in a manner that permits it to fold or collapse to a size that is more convenient for travel and/or storage (smaller, thinner, shorter and/or the like). For example: (i) the platform may fold in a downwards direction, so that it becomes perpendicular with the exercise sitting apparatus 1, rather than horizontal; (ii) the legs or base may fold inwardly; and/or (iii) the extensions (for the arm rests or hand grips) may fold inwardly.

A wide variety of other optionally parts, components and/or materials may be included in the exercise sitting apparatus of the present invention, for example, a water bottle holder, a water bottle, a towel holder, a towel, a counter for counting calories burned during exercise using the exercise sitting apparatus, a timer for timing the duration of the exercise, an alarm or other auditory and/or visual signal that sounds or becomes evident when a specified duration of exercise has been completed, a device that tracks the heart rate of the user during the duration of the exercise, other known parts, components and/or materials that are conventionally present on exercise equipment, such as exercise bicycles, tread mills and stair steps, and the like.

A wide variety of suitable locking mechanisms that may, optionally, be employed in connection with the turntable assembly, the slide plate assembly, the track, components that adjust the height of the exercise sitting apparatus 1, components that adjust the arm rests and/or extensions and/or other components of the exercise sitting apparatuses of the invention 1 are commercially available from sources that are known by those of ordinary skill in the art.

Method of Use

The exercise sitting apparatus of the invention, such as the above-described multi-directional upright embodiment, allows a user to develop, strengthen, stretch, increase the flexibility of and/or rehabilitate a wide variety of muscles and/or body parts which include, but are not limited to, the abdominal, lower back, external oblique, buttocks and hip flexor muscles, and also to eliminate or reduce pain (when present).

The above results can generally be accomplished with the exercise sitting apparatus by the user sitting on the platform, either with his or her feet not touching or touching the floor, and using his or her legs, buttocks, hips and/or back, and/or associated muscles, to swivel the user's hips (rotate them in a circular manner in a clockwise or counterclockwise direction or in some other manner), or otherwise move one or more of these body parts and/or muscles, in one or more of a variety of different manners, including, but not limited to, a combination of any of the following:

(1) with the turntable in a locked position (so that the turntable cannot rotate, either in a clockwise or counterclockwise direction);
(2) with the turntable in an unlocked position (so that the turntable has an ability to partially or fully rotate in a clockwise or counterclockwise direction);
(3) with the slide plate assembly (or seat bowl assembly) in a locked position (so that the slide plate assembly cannot rotate, either in a clockwise or counterclockwise direction);
(4) with the slide plate assembly (or seat bowl assembly) in an unlocked position (so that the slide plate assembly has an ability to partially or fully rotate in a clockwise or counterclockwise direction);
(5) with the platform in a locked position (so that the platform does not have an ability to move from one location to another location along the track of the slide plate assembly); and/or
(6) with the platform in a free or unlocked position (so that the platform has an ability to move from one location to another location along the track of the slide plate assembly, such as back and forth from one end to the other end in a manner that is from front to back, back to front, left to right, right to left and/or in any other direction, with no friction (resistance) to full friction, or with a friction at any level in between no friction and full friction).

The above activities can be facilitated for a user by the user sitting upright on the apparatus while holding onto mounted hand grips with the user's feet either not touching or touching the ground. The handgrips are provided for the user to hold onto in order to stabilize the user's upper body. The hand grips generally provide the user with stability and leverage, which permits the user to engage and isolate, for example, the abdomen, back, hips, hip flexors and other body parts and/or muscles, thus allowing the user to move the hips in any direction.

The seat height and handgrips of the exercise sitting apparatus of the invention can each, optionally, be adjusted to properly and comfortably accommodate taller or shorter users. Such an adjustment can prevent a user's feet from touching, or dragging on the ground, and also allows the user's hands and arms to remain below shoulder height (keeping it ergonomic).

When using the exercise sitting apparatus, the user can generally move the hips in multi-directions because the platform of the exercise sitting apparatus is preferably rotatably mounted upon a multi directional swivel system (slide plate assembly). The seat and swivel system move in a wide variety of directions, for example, front to back, side to side, varying degrees diagonally and twisting (like Chubby Checker). The swivel hips motion generally starts with the user in a sitting position on the apparatus and with the user's hips and buttocks in a neutral position. The user can then engage the core body muscles, such as the abdominal, lower back, external oblique, buttocks and hip flexor muscles, by pushing the hips out from under the chest and shoulders to the right (or in any other linear or other direction), while preferably maintaining the upper body in a fixed position and holding onto hand grips. The user can then proceed to move the hips in a clockwise or counter clockwise motion and, thus, swiveling the hips in a circular motion. The size of the circles can vary widely depending upon a variety of factors, such as how wide or far the user swings the hips out from the center/neutral point, and whether the user has a full (normal) range of motion, or a more limited range of motion than usual, for example, as a result of an illness, accident or other cause, and the like. This multi-directional exercise sitting apparatus allows the user to target any or all of the core muscles of the body (front, back, side to side, diagonally), as well as other muscles, structures and organs.

The exercise sitting apparatus of the invention may, optionally, also include one or more various tension mechanisms provided by one or more tension knobs, compression springs, hydraulic mechanisms (cylinders, shock absorbers and the like), clamps, brakes and/or other like mechanisms known by those of skill in the art. In this case, the user can, optionally, adjust the tension for the movement of the platform along the slide plate, for the ability of the slide plate to partially or fully rotate in a clockwise or counterclockwise direction, or for both, according to the user's level of comfort and/or fitness.

The length of time that a user will use an exercise sitting apparatus of the invention may vary widely depending upon a wide variety of factors, such as the age, general health, stamina and weight of the particular user, the preference of the user and recommendations of medical personnel, physical therapists, chiropractors and the like, which may readily be determined by a person of ordinary skill in the art. It is, however, often preferable that a user employ the exercise sitting apparatus for a period of time ranging from about 1 to about 10 minutes, more preferably from about 1 to about 5 minutes, and most preferably from about 1 to about 3 minutes at one time. Further, the exercise sitting apparatus may be used one or more times each day, such as 1, 2, 3, 4, 5, 6, 7, 8, 9, 10, 11 or 12 times each day. However, it is often preferable that the user use the exercise sitting apparatus for from about 1 to about 12 times per day, and more preferably from about 2 to about 8 times per day and most preferably from about 3 to about 4 times per day.

Method of Production

The exercise sitting apparatus of the present invention can be manufactured using customary methods, equipment and material known by those of skill in the art for producing chairs and/or exercise equipment. The various components of the exercise sitting apparatus may, for example, be made from a wide variety of metals, plastics, woods, rubbers, carbon fibers, fiber glasses, fabrics, paddings and/or other materials that are molded or otherwise shaped using conventional methods.

Unless specified otherwise herein, all parts of the exercise sitting apparatus of the invention may be of any suitable size and shape that permit the exercise sitting apparatus 1, or a part thereof, to have the functions and characteristics described herein. Such sizes and shapes may vary widely, and may readily be determined by those of ordinary skill in the art using the information and drawings that are provided herein.

Unless specified otherwise herein, all parts of the exercise sitting apparatus of the invention may be permanently or removably, pivotally, rotatably, in a fixed manner or otherwise coupled with, welded with, mounted (rotatably or otherwise) to and/or otherwise attached to an adjacent or other part of the exercise sitting apparatus of the invention using conventional means for accomplishing such coupling, welding, mounting or attachment, such as using glue, welding techniques, nails, nuts (wing nuts and other types), bolts, screws, studs, slots and/or holes.

Sources of Ingredients

All of the parts, materials and equipment that are employed to manufacture the exercise sitting apparatuses of the present invention are commercially available from sources known by those of skill in the art, for example, McMaster-Carr (Los Angeles, Calif.), Bishop Wisecarver (Pittsburg, Calif.), Equipment Net, Inc. (Boca Raton, Fla.), Fitness Rush (Mableton, Ga.), Sportaid (Loganville, Fla.), Maintenance Specialties (Bradenton, Fla.), New Yielding Co., Ltd. (Tainan, Taiwan), Serv-U (Champaign, Ill.), Key Bellevilles, Inc. (Leechburg, Pa.) and Office Depot (Delray Beach, Fla.).

While the present invention has been described herein with specificity, and with reference to certain preferred embodiments thereof, those of ordinary skill in the art will recognize numerous variations, modifications and substitutions of that which has been described which can be made therein, as by adding, combining, rearranging or subdividing parts, or substituting equivalents, which are within the scope and spirit of the invention. It is intended that all of these modifications and variations be within the scope of the present invention as described and claimed herein, and that the invention be limited only by the scope of the claims which follow, and that such claims be interpreted as broadly as is reasonable.

Throughout this document various patents and other publications have been cited. The entireties of each of these patents and other publications are hereby incorporated by reference herein.

What is claimed is:

1. An exercise sitting apparatus comprising:

a seat assembly having an upper side defining a generally planar upper surface adapted to support a user in a seated position and a lower side;

a base assembly disposed below the seat assembly and configured to rest upon a floor;

a rotation assembly coupled to and disposed between the lower side of the seat assembly and the base assembly, the rotation assembly configured to enable rotation of the seat assembly relative to the base assembly only about an axis of rotation oriented generally perpendicular to the upper surface of the seat assembly;

a tension mechanism coupled to the rotation assembly, the tension mechanism having a tension knob configured to provide adjustable frictional resistance endured by the rotation assembly for rotation of the seat assembly about the axis of rotation throughout the rotational range of the seat, controllable by the user; and a hold support coupled to the base assembly to remain stationary relative to the base assembly while the seat assembly rotates such that a user can grasp or otherwise brace oneself with the user's hand or forearm while causing the seat assembly to rotate relative to the base assembly about the axis of rotation.

2. An exercise sitting apparatus as defined in claim 1, wherein the rotation assembly includes an upper plate having an upper side and a lower side, in which upper side of the upper plate is coupled to the lower side of the seat assembly; and a turntable operably coupled between the upper plate and the base assembly, the turntable configured to enable partial or full rotation of the seat assembly in a clockwise and/or clockwise direction relative to the base assembly.

3. An exercise sitting apparatus as defined in claim 1, wherein the rotation assembly includes a locking mechanism that has an ability to maintain the rotation assembly in a stationary position when the locking mechanism is locked.

4. An exercise sitting apparatus as defined in claim 3, wherein the locking mechanism is a spring loaded ring pull.

5. An exercise sitting apparatus as defined in claim 1, wherein the hold support includes a pair of arm rests coupled to the base assembly and disposed in spaced relationship on opposing sides of the seat assembly.

6. An exercise sitting apparatus as defined in claim 1, wherein the base assembly includes a leg frame, and wherein the leg frame can be partially or fully folded, collapsed or moved.

7. An exercise sitting apparatus as defined in claim 6, wherein the leg frame includes a locking mechanism or release means that permits the leg frame to be: (i) locked into an open position when the locking mechanism or release means is locked, and provided in a folded, collapsed or moved position when the locking mechanism or release means is unlocked; (ii) in an open position when the locking mechanism or release means is unlocked, and provided in a folded, collapsed or moved position when the locking mechanism or release means is locked; or (iii) locked into both an open position and a folded, collapsed or moved position.

8. An exercise sitting apparatus as defined in claim 7, wherein the locking mechanism is a two-way locking mechanism or a frame pivot point release mechanism.

9. An exercise sitting apparatus comprising:

a seat assembly having an upper side upon which a user may sit and a lower side;

a base assembly disposed below the seat assembly and configured to rest upon a floor in a manner that is relatively stable;

a rotation assembly disposed between the lower side of the seat assembly and the base assembly, the rotation assembly configured enable rotation of the seat assembly relative to the base assembly;

a slide assembly disposed between the lower side of the seat assembly and the base assembly, the slide assembly configured to enable movement of the seat assembly along linear path on a generally horizontal plane, the slide assembly further configured to partially or fully rotate relative to the base assembly;

a tension mechanism coupled to the slide assembly and configured to provide adjustable resistance for movement of the seat assembly along the linear path defined by the slide assembly controllable by the user; and a hold support coupled to the base assembly and positioned to remain stationary relative to the base assembly while the seat assembly rotates such that a user can grasp or otherwise brace oneself with the user's hand or forearm while causing the seat assembly to rotate or otherwise move relative to the base assembly.

10. An exercise sitting apparatus as defined in claim 9, wherein the slide plate assembly includes at least two locking mechanisms, wherein one locking mechanism has an ability to maintain the slide plate assembly in a stationary position when the locking mechanism is locked, and wherein the second locking mechanism has an ability to maintain the platform in a stationary position on the track of the slide plate assembly when the locking mechanism is locked.

11. An exercise sitting apparatus as defined in claim 9, further comprising a tension mechanism coupled to the rotation assembly and configured to provide adjustable resistance for rotation of the seat assembly controllable by the user.

12. An exercise sitting apparatus as defined in claim 9, wherein the rotation assembly includes an upper plate having an upper side and a lower side, in which upper side of the upper plate is coupled to the lower side of the seat assembly; and a turntable operably coupled between the upper plate and the base assembly, the turntable configured to enable partial or full rotation of the seat assembly in a clockwise and/or clockwise direction relative to the base assembly.

13. An exercise sitting apparatus as defined in claim 9, wherein the base assembly includes one or more lockable or non-lockable rolling devices.

14. An exercise sitting apparatus as defined in claim 9, further comprising a vertical displacement assembly coupled to the seat assembly that permits the user to adjust the height of the seat assembly to be adjusted upwards or downwards, or both upwards and downwards.

15. An exercise sitting apparatus as defined in claim 9, wherein the exercise sitting apparatus additionally comprises a back support coupled to the seat assembly.

16. An exercise sitting apparatus as defined in claim 15, wherein the back support device is upwardly or downwardly adjustable, or both upwardly and downwardly adjustable, or is forwardly or backwardly adjustable, or both forwardly and backwardly adjustable, or is adjustable in each of the foregoing manners.

17. An exercise sitting apparatus comprising:

a seat assembly having an upper side upon which a user may sit and a lower side;

a base assembly disposed below the seat assembly and configured to rest upon a floor;

a seat bowl assembly coupled between the lower side of the seat assembly and the base assembly, the seat bowl assembly including a tension assembly comprising a tension knob having a threaded portion and a nut, a first seat bowl having an opening in its center for receiving the threaded portion of the tension knob, a second seat bowl having an opening in its center for receiving the threaded portion of the tension knob, and a seat mount bracket for mounting the seat bowl assembly to the lower side of the seat assembly; and a slide assembly coupled between the lower side of the seat assembly and the base assembly and configured to enable movement of the seat assembly along linear path on a generally horizontal plane.

18. An exercise sitting apparatus as defined in claim 17, wherein the base assembly includes a leg frame, and wherein the leg frame can be partially or fully folded, collapsed or moved.

19. An exercise sitting apparatus as defined in claim 17, further comprising a hold support coupled to the base assembly to remain stationary relative to the base assembly while the seat assembly rotates such that a user can grasp or otherwise brace oneself with the user's hand or forearm while causing the seat assembly to rotate or otherwise move relative to the base assembly.

20. An exercise sitting apparatus as defined in claim 17, wherein the slide assembly includes a slide plate having an upper side and a lower side, one or more rollers, a track, a base plate having an upper side and a lower side and a locking mechanism, wherein the slide assembly has an ability to partially or fully rotate independently of the platform in a clockwise direction, a counterclockwise direction or in either direction when it is not maintained in a stationary position by a locking mechanism or other means.

21. An exercise sitting apparatus as defined in claim 20, further comprising a tension mechanism coupled to the slide assembly and configured to provide adjustable resistance for movement of the seat assembly along the linear path defined by the slide assembly controllable by the user.

* * * * *